US005824930A

United States Patent [19]

Ura et al.

[11] Patent Number: 5,824,930

[45] Date of Patent: Oct. 20, 1998

[54] KEYBOARD MUSICAL INSTRUMENT HAVING KEY MONITOR EXACTLY DISCRIMINATING KEY MOTION

[75] Inventors: Tomoyuki Ura; Tsutomu Sasaki, both of Shizuoka-ken, Japan

[73] Assignee: Yamaha Corporation, Japan

[21] Appl. No.: 658,700

[22] Filed: Jun. 5, 1996

[30] Foreign Application Priority Data

Jun. 9, 1995 [JP] Japan ..... 7-143752
Oct. 18, 1995 [JP] Japan ..... 7-270322

[51] Int. Cl.[6] ..... G10G 3/04

[52] U.S. Cl. ..... 84/462; 84/171

[58] Field of Search ..... 84/462, 463, 433, 84/171, 20

[56] References Cited

U.S. PATENT DOCUMENTS

| | | | |
|---|---|---|---|
| 4,736,662 | 4/1988 | Yamamoto | 84/1.09 |
| 4,913,026 | 4/1990 | Kaneko et al. | 84/21 |
| 5,001,339 | 3/1991 | Starkey et al. | 250/229 |
| 5,231,283 | 7/1993 | Starkey et al. | 250/229 |
| 5,254,804 | 10/1993 | Tamaki et al. | 84/626 |
| 5,552,559 | 9/1996 | Sugiyama et al. | 84/171 |

*Primary Examiner*—Michael L. Gellner
*Assistant Examiner*—Shih-yung Hsieh
*Attorney, Agent, or Firm*—Graham & James LLP

[57] ABSTRACT

A keyboard musical instrument continuously monitors a key motion, and determines present key state on the basis of the previous key state, the present key position and a lapse of time during the previous key state so as to exactly control a tone generation.

11 Claims, 25 Drawing Sheets

| n | En | RnH | RnL |
|---|---|---|---|
| 0 | | | |
| 1 | | | |
| 2 | | | |
| 3 | | KEY STATE | PRESENT KEY POSITION |
| 4 | | | TABLE NUMBER |
| 5 | TIME OF A/D CONVERSION | | KEY NUMBER |
| 6 | TIMER | | CHANNEL FOR A/D |

KEYBOARD MUSICAL INSTRUMENT HAVING KEY MONITOR EXACTLY DISCRIMINATING KEY MOTION

FIELD OF THE INVENTION

This invention relates to a keyboard musical instrument and, more particularly, to a keyboard musical instrument equipped with a key monitor exactly discriminating a key motion.

DESCRIPTION OF THE RELATED ART

An automatic player piano is a typical example of the keyboard musical instrument. The automatic player piano is equipped with solenoid-operated actuators beneath a keyboard, and a controller selectively energizes the solenoid-operated actuators for generating acoustic sounds on the basis of music data codes representative of an original performance. The music data codes are formed from pieces of music data information obtained through a monitoring on the key motions during the original performance on the keyboard, and the recording system is incorporated in the automatic player piano of the type recording a performance on the keyboard thereof. The recording system includes a plurality of key sensors, and the key sensors are provided in the vicinity of the trajectories of the keys. When a player depresses a key, the associated key sensor detects the depressed key, and the controller generates music data codes representative of the depressed key, the key velocity and so fourth. The key sensor further detects a released key, and the controller generates music data codes representative of the released key and the key motion.

Another example of the keyboard musical instrument is known as "silent piano". The silent piano is disclosed in U.S. Pat. No. 5,374,775, and an acoustic piano, an electronic sound system and a hammer stopper form in combination the silent piano. The hammer stopper is changed between a free position and a blocking position. While the hammer stopper is staying in the free position, the silent piano behaves as a standard acoustic piano, and a player is playing the piano through the acoustic sounds. However, when the stopper is changed to the blocking position, the hammer stopper prevents the strings from the hammers, and the hammers rebound on the hammer stopper before a strike at the string. For this reason, the silent piano does not generate an acoustic sound. The key sensors and the controller are incorporated in the electronic sound system. The key sensors monitors the key motions, and the controller generates the music data codes. The music data codes are immediately supplied to a tone generator, and the tone generator tailors an audio signal. The audio signal is, by way of example, supplied to a headphone, and produces electronic sounds in synchronism with the fingering on the keyboard.

Thus, the key sensors are indispensable for the keyboard musical instrument of the type compromising an acoustic piano and an electronic sound system. FIGS. 1A to 1C illustrate a key 1 associated with a key sensor 2. The key sensor 2 includes two photo-couplers 2*a* and 2*b* fixed to a bracket 2*c* and a shutter plate 2*d* attached to the lower surface of the key 1. The bracket 2*c* is mounted on a key bed 3, and, accordingly, the photo-couplers 2*a* and 2*b* are stationary with respect to the key bed 3. On the other hand, the key 1 is turnably supported by a balance rail (not shown), and the balance rail is mounted on the key bed 3. Therefore, the key 1 is turnable with respect to the key bed 3, and, accordingly, the shutter plate 2*d* is movable with respect to the key bed 3 and the photo-couplers 2*a*/2*b*.

While the key 1 is staying at the rest position, an oblique edge 2*e* of the shutter plate 2*d* is over the light beams of the photo-couplers 2*a*/2*b* as shown in FIG. 1A. The photo-couplers 2*a* and 2*b* convert light into electric signals, and the potential levels of the electric signals are proportional to the intensity of the light. Both of the photo-couplers 2*a* and 2*b* maintain the electric signals at a high potential level, and the prior art key sensor generates a two-bit key position signal of [00].

A player exerts force on the key 1, and the key 1 starts a downward motion 4 from the rest position toward the end portion. When the key 1 is moved by a certain distance, the oblique edge 2*e* reaches the light beam of the photo-coupler 2*a*, and the shutter plate 2*d* intersects the light beam of the photo-coupler 2*a*. However, the oblique edge 2*e* is still over the light beam of the photo-coupler 2*b*, and the light beam bridges the gap between the photo-emitting element and the photo-detecting element of the other photo-coupler 2*b* as shown in FIG 1B. For this reason, although the photo-coupler 2*a* changes the electric signal to a low potential level, the other photo-coupler 2*b* still maintains the electric signal at the high potential level.

The key 1 is further moved downwardly, and the oblique edge 2*e* reaches the light beam of the other photo-coupler 2*b* as shown in FIG. 1C. The shutter plate 2*d* intersects both of the light beams, and the photo-coupler 2*b* changes the electric signal to the low potential level. As a result, both of the photo-couplers 2*a*/2*b* have changed the electric signals to the low potential level.

Thus, the prior art key sensor changes the two-bit key position from [00] through [01] to [11], and is capable of detecting three different positions of the key 1 on the trajectory from the rest position to the end position. The prior art key sensor gives a timing for generating an electronic sound, and the controller supplies the music data codes representative of the electronic sound to be generated to the tone generator at the timing. The tone generator immediately tailors the audio signal, and the headphone produces the electronic sound. If the prior art key sensor increases the photo-couplers, the detectable positions are also increased.

However, the prior art key sensor can not exactly detect the key position. This is because of the fact that there are various members between the photo-couplers 2*a*/2*b* and the shutter plate 2*d*. The photo-couplers 2*a*/2*b* are supported by the bracket 2*c*, and the shutter plate 2*d* is attached to the key 1 turnably supported by the balance rail. The bracket 2*c*, the balance rail and the key bring respective manufacturing tolerances into the relative position between the shutter plate 2*d* and the photo-couplers 2*a*/2*b*. Moreover, installation errors are unavoidable. For this reason, the relative position between the shutter plate 2*d* and the photo-couplers 2*a*/2*b* is different among the products, and the prior art key sensor requires a careful calibration or a careful adjustment of the relative position between the shutter plate and the photo-couplers.

A self-adjustable position sensor is proposed in U.S. Pat. Nos. 5,001,339 and 5,231,283. An analog position sensor is provided for a key, and changes the analog output signal together with the key moved from the rest position to the end position. A computer software determines a threshold at a detecting point after the installation of the position sensor, and automatically varies the threshold depending upon the manufacturing tolerances and the installation error. Therefore, a timing for a tone generation is constant regardless of the manufacturing tolerances and the installation error.

While a player is depressing the key, the position sensor continuously changes the analog output signal, and a controller compares the value of the analog output signal with the threshold. When the analog output signal reaches the threshold, the controller acknowledges the detecting point.

The prior art self-adjustable position sensor allows a controller to ignore the individuality between the products. However, the prior art self-adjustable position sensor can not discriminate how the player depresses the key.

If a player slowly depresses a key of a standard acoustic piano, the associated hammer escapes from the jack on the way from the rest position to the end position; however, the moment exerted to the hammer is too small to reach the associated string, and the hammer returns to the initial position without a strike at the string. On the other hand, when the player strongly depresses the key, the jack imparts large moment to the hammer, and the hammer strikes the string for generating the piano sound. Thus, although both key touches cause the key to pass an intermediate point between the rest position and the end position, the hammer motions are different, and the different hammer motions results in the piano sound and the loss of the sound. The prior art self-adjustable position sensor gives the timing for the tone generation at the detecting point regardless of the key touch, and both electronic sounds are produced through the headphone.

The prior art self-adjustable position sensor further provides a timing for a tone termination, and the controller instructs the tone generator to terminate the electronic sound when the analog position signal has a threshold for the tone termination. An acoustic piano terminates the piano sound with a damper mechanism. When the player releases the depressed key, the key is moved from the end position toward the rest position, and brings the damper head into contact with the vibrating string. The damper head takes up the vibrations, and terminates the piano sound. The damper head is brought into contact with the vibrating string on the way from the end position toward the rest position, and the detecting point is adjusted to the timing when the damper head is brought into contact with the vibrating string. However, the motion of damper head is various in different key motions, and, accordingly, the decay of electronic sound is not constant. However, the prior art self-adjustable position sensor can not discriminate the key motions affecting the decay of electronic sound.

Thus, the keyboard musical instrument equipped with the prior art self-adjustable position sensors can not produce the electronic sound exactly corresponding to the key motions.

SUMMARY OF THE INVENTION

It is therefore an important object of the present invention to provide a keyboard musical instrument which is equipped with a key monitor for exactly controlling a tone generation.

In accordance with the present invention, there is provided a keyboard musical instrument for generating sounds, comprising: a keyboard including a plurality of keys each reciprocally moved between a rest position and an end position; a sound generating means responsive to a first piece of control information for starting to generate a sound specified by each of the plurality of keys on the way toward the end position and a second piece of control information for terminating the sound on the way toward the rest position; a plurality of key sensors respectively monitoring the plurality of keys for generating key position signals respectively representative of motions of associated keys, each of the key position signals continuously varying a value along a trajectory of one of the plurality of keys having a plurality of reference points bounding sections of the trajectory; and a sound controlling means connected to the plurality of key sensors, and controlling the sound generating means, and the sound controlling means including a discriminating sub-means periodically comparing the value of the aforesaid each of the plurality of key position signals with respective thresholds of the plurality of reference points for determining one of the sections where the aforesaid each of the plurality of keys is moved, a key-state determining sub-means for determining a present key state of the aforesaid each of the plurality of keys on the basis of the aforesaid one of the sections and a previous key state which was previously determined by the discriminating sub-means, and a control information generating sub-means for generating a first piece of control information indicative of a generation of sound for the aforesaid each of the plurality of keys after the present key state is representative of a ready for tone generation, the control information generating sub-means further generating a second piece of control information indicative of a termination of sound for the aforesaid each of the plurality of keys when the value of the aforesaid each of the plurality of key position signals is matched with one of the thresholds after entry into the ready for tone generation.

BRIEF DESCRIPTION OF THE DRAWINGS

The features and advantages of the key sensor and the keyboard musical instrument according to the present invention will be more clearly understood from the following description taken in conjunction with the accompanying drawings in which.

DESCRIPTION OF THE PREFERRED EMBODIMENT

Structure of Keyboard Musical Instrument

Figure 1A:
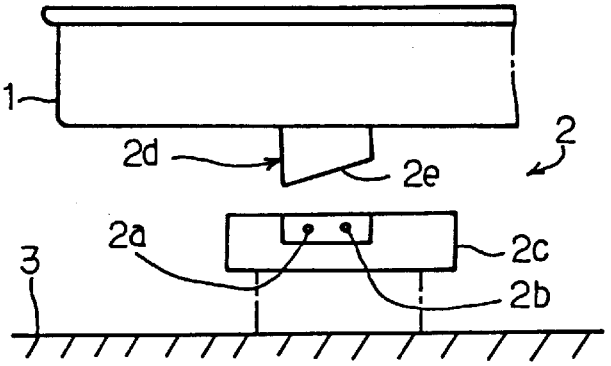
Fig. 1A PRIOR ART
FIGS. 1A to 1C are schematic side views showing the relation between the prior art key sensor and the key position.
Figure 1B:
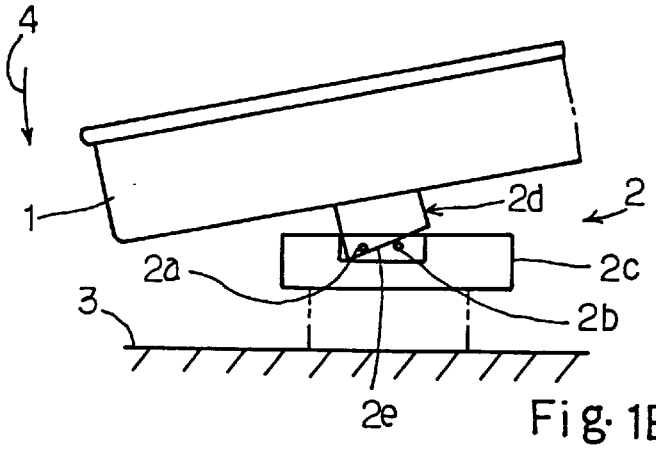
Fig. 1B PRIOR ART
Figure 1C:
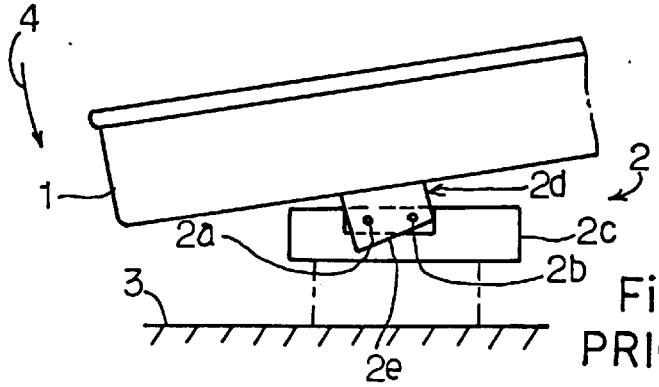
Fig. 1C PRIOR ART
Figure 2:
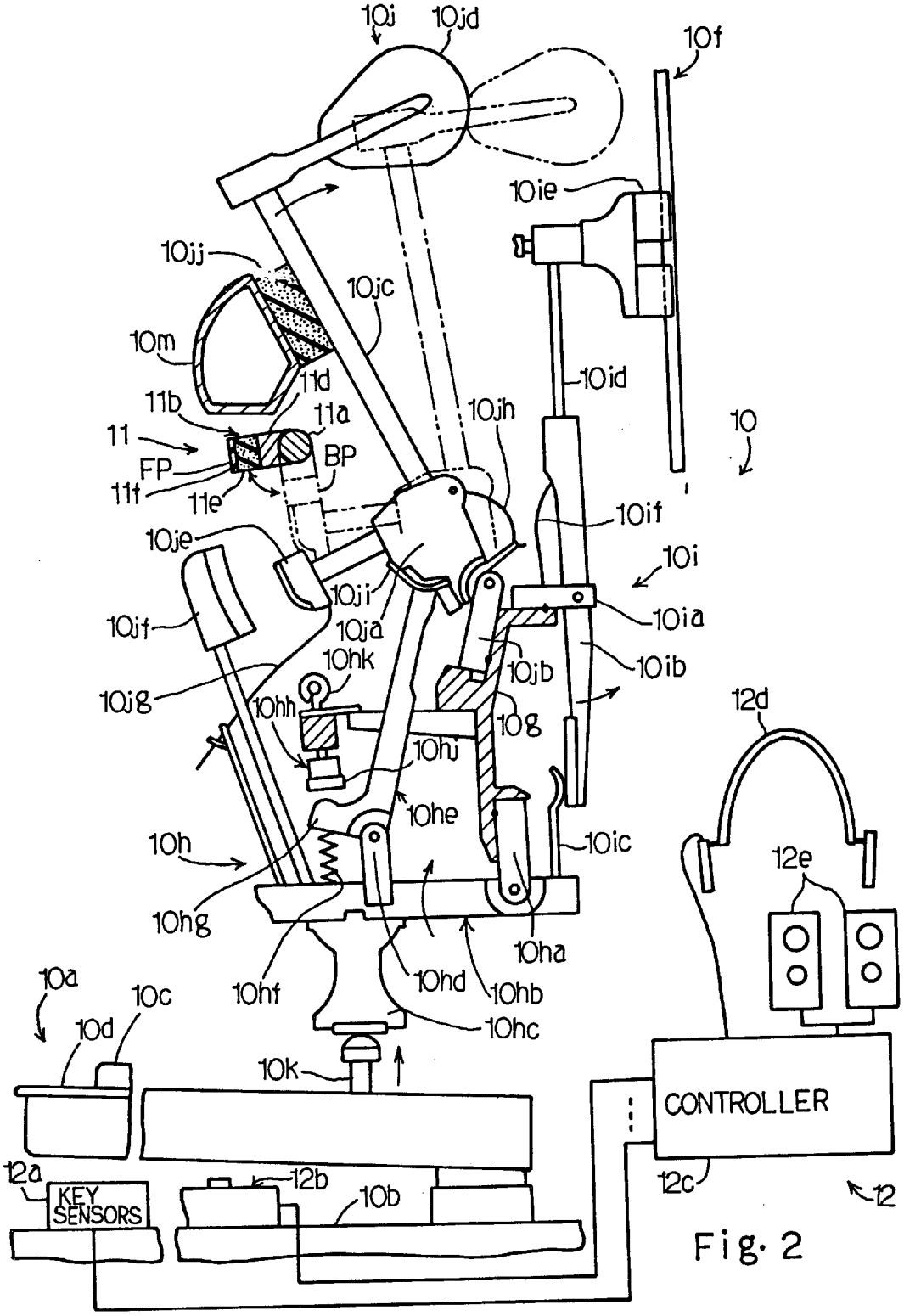
FIG. 2 is a side view showing the structure of a keyboard musical instrument according to the present invention.

Referring to FIG. 2 of the drawings, a keyboard musical instrument embodying the present invention largely comprises an acoustic piano 10, a silent system 11 and an electronic system 12. In the following description, word "front" is indicative of a position closer to a player sitting in front of the acoustic piano than a "rear" position, and directions "clockwise" and "counter clockwise" are determined in a figure where the rotating member is illustrated.

The acoustic piano 10 is similar to a standard upright piano, and includes a keyboard 10*a* provided over a key bed 10*b*. Eighty-eight black and white keys 10*c* and 10*d* form in combination the keyboard 10*a*, and are turnable around balance pins 10*e* (see FIG. 3). The black and white keys 10*c* and 10*d* extend in a fore-and-aft direction of the acoustic piano 10, and front end portions of the black and white keys 10*c* and 10*d* are exposed to a player. Notes of a scale are respectively assigned to the black and white keys 10*c* and 10*d*, respectively.

While a force is not being exerted on the keys 10*c* and 10*d* by the player, the black and white keys 10*c* and 10*d* are staying in respective rest positions. The player depresses the black and white keys 10*c* and 10*d*, and the front portions of the black and white keys 10*c* and 10*d* are downwardly moved. When the front portions are not further moved, the black and white keys 10*c* and 10*d* arrive at respective end positions.

The acoustic piano 10 further comprises a plurality of strings 10*f* provided in front of a vertically extending frame (not shown) and stretched between tuning pins (not shown) and hitch pins (not shown). Each string is implemented by three music wires, and vibrates for generating an acoustic sound. The acoustic sounds have respective notes identical with the notes of the scale assigned to the associated keys 10*c*/10*d*.

A center rail 10*g* is positioned in front of the strings 10*f*, and laterally extends over the rear end portions of the black and white keys 10*c* and 10*d*. The center rail log is bolted to action brackets (not shown) at both ends and an intermediate point thereof, and the action brackets are placed on the key bed 10*b*.

The acoustic piano 1 further comprises a plurality of key action mechanisms 10*h* functionally connected to the black and white keys 10*c* and 10*d*, respectively, a plurality of damper mechanisms 10*i* actuated by the key action mechanisms 10*h* for momentarily leaving the associated strings 10*f* and a plurality of hammer assemblies 10*j* driven for rotation by the key action mechanisms 10*h*, respectively.

When the player depresses one of the black and white keys 10*c* and 10*d*, the depressed key 10*c*/10*d* actuates the key action mechanism 10*h* so as to rotate the hammer assembly 10*j*, and causes the damper mechanism 10*i* to leave the associated string 10*f*. The hammer assembly 10*j* is driven for rotation, and strikes the associated string 10*f*. The strings 10*f* vibrate so as to generate an acoustic sound.

When the player releases the key 10*c*/10*d*, the key action mechanism 10*h* and the hammer assembly 10*i* return to the initial positions or the home positions, and the damper mechanism 10*i* is brought into contact with the string 10*f*, thereby absorbing the vibrations.

The key action mechanisms 10*h* are similar in constitution to one another, and each key action mechanism 10*h* includes a whippen flange 10*ha* bolted to a lower end portion of the center rail 10*g* and a whippen assembly 10*hb* rotatably connected to the whippen flange 10*ha*. The whippen assembly 10*hb* has a heel 10*hc* held in contact with a capstan screw 10*k* implanted into the rear end portion of the associated black or white key 10*c*/10*d*.

The key action mechanism 10*h* further includes a jack flange 10*hd* upright from a middle portion of the whippen assembly 10*hb*, a jack 16*he* turnably supported by the jack flange 10*hd*, a jack spring 10*hf* inserted between the whippen assembly 10*hb* and a toe 10*hg* of the jack 10*he* and a regulating button sub-mechanism 10*hh* opposed to the toe 10*hg*. The jack 10*he* is shaped into an L-letter configuration, and the jack spring 10*hf* urges the jack 10*he* in the clockwise direction at all times.

While the black or white key 10*c*/10*d* is staying in the rest position, the capstan button 10*k* horizontally maintains the whippen assembly 10*hb*, and the toe 10*hg* is spaced from the regulating button sub-mechanism 10*hh*. The regulating button sub-mechanism 10*hh* has a regulating button 10*hj* protectable toward and retractable from the toe 10*hg* by turning a regulating screw 10*hk*.

If the gap between the toe 10*hg* and the regulating button 10*hj* is increased, the hammer assembly 10*j* escapes from the jack 10*he* later. On the other hand, if the gap is decreased, the hammer assembly 10*j* escapes earlier. A jack stop rail felt (not shown) projects from the center rail 10*g*, and restricts the motion of the jack 10*he*. The jack stop rail felt is regulable to an appropriate position.

When the toe 10*hg* is brought into contact with the regulating button 10*hj*, the reaction impedes the motion of the whippen assembly 10*hb* and, accordingly, the depressed key 10*c*/10*d*, and the player feels the key 10*c*/10*d* heavier than before. Thus, the jack 10*he* and the regulating button sub-mechanism 10*hh* deeply concern the unique key-touch, and the position of the regulating button 10*hj* defines the starting point of the escape of the hammer assembly 10*j*.

The damper mechanisms 10*i* are similar in constitution to one another, and includes a damper lever flange 10*ia* fixed to an upper surface of the center rail 10*g*, a damper lever 10*ib* rotatably supported by the damper lever flange 10*ia*, a damper spoon 10*ic* implanted into the rear end portion of the whippen assembly 10*hb*, a damper wire 10*id* projecting from the damper lever 10*ib*, a damper head 10*ie* fixed to the damper wire 10*id* and a damper spring 10*if* urging the damper lever 10*ib* in the clockwise direction.

While the black or white key 10*c*/10*d* is staying in the rest position, the damper spoon 10*ic* does not rearwardly push the damper lever 10*ib*, and the damper head 10*ie* is held in contact with the string 10*f*.

When the player depresses the black or white key 10*c*/10*d* from the rest position to the end position, the capstan screw 10*k* pushes up the whippen assembly 10*hb*, and the whippen assembly 10*hb* is rotated in the clockwise direction. The whippen assembly 10*hb* causes the damper spoon 10*ic* to rearwardly push the damper lever 10*ib*. As a result, the damper lever 10*ib* is rotated in the counter clockwise direction, and the damper head 10*ie* leaves the associated string 10*f*.

On the other hand, when the black or white key 10*c*/10*d* is released, the whippen assembly 10*hb* is rotated in the counter clockwise direction, and the damper spoon 10*ic* removes the pressure from the damper lever 10*ib*. As a result, the damper spring 10*if* urges the damper lever 10*ib* in the clockwise direction, and the damper head 10*ie* is brought into contact with the string 10*f*, again.

Though not shown in FIG. 2, the damper assemblies 10*i* are associated with a damper rod, and is linked to a damper pedal. When the player steps on the damper pedal, the damper rod causes all the damper heads 10*ie* to simultaneously leave the strings.

The hammer assemblies 10*j* are also similar in arrangement to one another. Each of the hammer assemblies 10*j* includes a hammer butt 10*ja* turnably supported by a butt flange 10*jb* fixed to the center rail 10*g*, a hammer shank 10*jc* upwardly projecting from the hammer butt 10*ja*, a hammer head 10*jd* fixed to the leading end of the hammer shank 10*jc*, a catcher 10*je* projecting from the hammer butt 10*ja*, a back check 10*jf* implanted into the front end portion of the whippen assembly 10*hb*, a bridle tape 10*jg* extending from the catcher 10*je* and a butt spring 10*jh* urging the hammer butt 10*ja* in the counter clockwise direction.

While the black or white key 10*c*/10*d* is staying in the rest position, the top surface of the jack 10*he* is in contact with a butt skin 10*ji* attached to a lower surface of the hammer butt 10*ja*, and the hammer shank 10*jc* is resting on a hammer rail cloth 10*jj* attached to a hammer rail 10*m*. The hammer rail 10*m* is supported through hammer rail hinges (not shown) by the action brackets (not shown) The bridle tape 10*jg* links the motion of the hammer assembly 10*j* with the motion of the whippen assembly 10*hb*, and does not allow the hammer assembly 10*j* to strike the string 10*f* twice.

Though not shown in FIG. 2, a soft pedal is connected to the hammer rail hinges, and the angular position of the hammer rail 10*m* is changed by manipulating the soft pedal.

The silent system 11 includes a shaft member 11*a* rotatably supported by side boards (not shown) and the action brackets, cushion units 11*b* attached to the shaft member 10*a* at intervals and an actuator 11*aa* (see FIG. 6) connected to one end of the shaft member 11*a*. The actuator 11*aa* changes the cushion units 11*b* between a free position FP and a blocking position BP.

The cushion units 11*b* in the blocking position BP are opposed to the catchers 10*je*, and the catchers 10*je* rebound on the cushion units 11*b* before the hammer heads 10*jd* reach the associated strings 10*f*. On the other hand, when the cushion units 11*b* are changed to the free position FP, the hammer assemblies 10*j* are rotated toward the associated strings 10*f*, and rebound on the strings 10*f*.

Each of the cushion units lib includes a rigid bracket lid fixed to the shaft member 11*a*, a resilient member 11*e* such as a felt sheet fixed to the rigid bracket 11*d* and a protective pad 11*f* attached to the resilient member 11*e*. A pair of limit switches 11*g* (see FIG. 6) sets the limit on the movable range of the shaft member 11*a*, and causes the cushion units 11*b* to be exactly changed between the free position FP and the blocking position BP. The catcher 10*je* rebounds on the protective pad 11*f*, and the resilient member 11*e* takes up the impact of the catcher 10*je*. Thus, the cushion unit 11*b* extinguishes noise at the impact.

The electronic system 12 includes a plurality of key sensors 12*a* respectively associated with the black and white keys 10*c*/10*d* for monitoring the key motions, a plurality of solenoid-operated actuator units 12*b* respectively provided beneath the black and white keys 10*c*/10*d*, a controller 12*c* connected to the key sensors 12*a* and the solenoid-operated actuator units 12*b* and a headphone 12*d* and/or a speaker system 12*e*.

Figure 3:
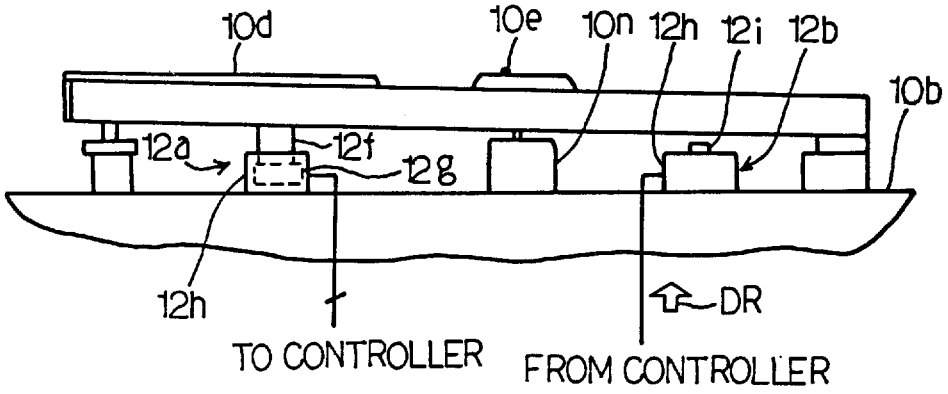
FIG. 3 is a side view showing the arrangement of a key sensor and a solenoid-operated actuator unit beneath a keyboard incorporated in the keyboard musical instrument.

As shown in FIG. 3, the key sensors 12*a* are placed in front of the balance rail 10*n*, and a shutter plate 12*f* and a photo-coupler 12*g* form in combination each of the key sensors 12*a*. The shutter plate 12*f* is attached to the lower surface of the associated key 10*c*/10*d*, and the photo-couplers 12*g* are accommodated in a sensor box 12*h* mounted on the key bed 10*b*. The shutter plate 12*f* proceeds into a gap formed in the associated photo-coupler 12*g*, and the photo-coupler 12*g* produces an analog key position signal AKP representative of present status or a motion of the associated key 10*c*/10*d*.

Figure 4:
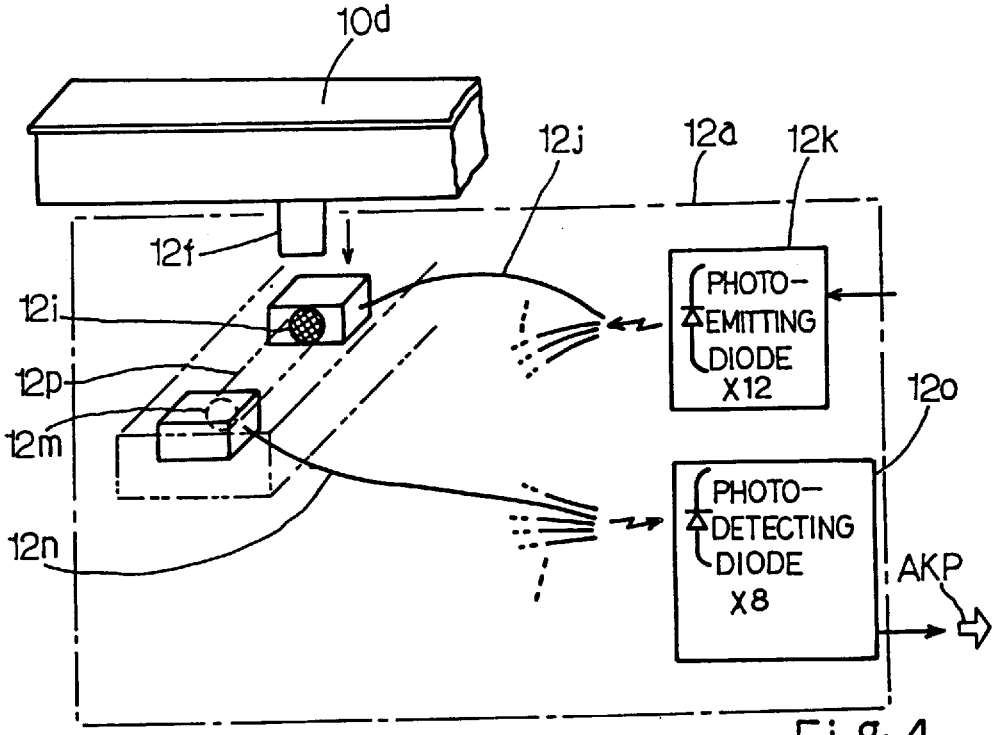
FIG. 4 is a schematic perspective view showing the key sensor.

The photo-coupler 12*g* is illustrated in FIG. 4 in detail. The photo-coupler 12*g* has a first sensor head 12*i* optically connected through an optical fiber 12*j* to a light source 12*k* and a second sensor head 12*m* optically connected through an optical fiber 12*n* to a photo-detector 12*o*. The first sensor head 12*i* is spaced from the second sensor head 12*m*, and the first sensor head 12*i* and the second sensor head 12*m* are aligned with each other.

The light source 12*k* converts electric current to light, and the light is propagated through the optical fiber 12*j* to the first sensor head 12*i*. The first sensor head 12*i* radiates a light beam 12*p* toward the second sensor head 12*m*, and the light is transferred from the second sensor head 12*m* through the optical fiber 12*n* to the photo-detector 12*o*. The photo-detector 12*o* converts the light to the analog key position signal AKP, and the potential level of the analog key position signal AKP is corresponding to the intensity of light transferred to the photo-detector 12*o*.

Figure 5:
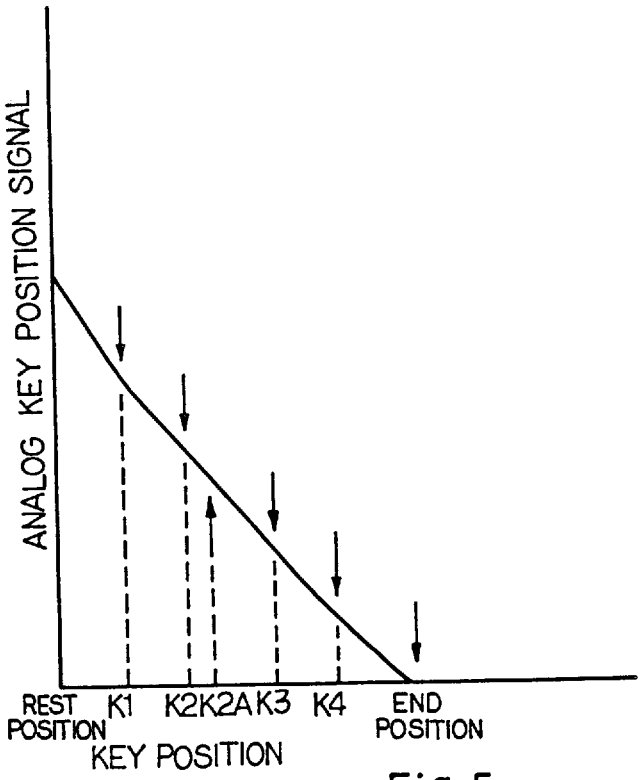
FIG. 5 is a graph showing a potential level of an analog key position signal in terms of a key stroke.

While the key 10*d* is downwardly moved, the shutter plate 12*f* proceeds into the gap between the first and second sensor heads 12*i* and 12*m*, and gradually intersects the light beam 12*p*. The analog key position signal AKP gradually decreases the potential level together with the intensity of the light received by the second sensor head 12*m*, and the analog key position signal AKP is representative of the present key position. In this instance, the light beam 12*p* has the diameter of 5 millimeter, and the key sensor 12*a* varies the analog key position signal AKP over the key stroke of 5 millimeter. For example, if the key 10*d* is moved from the rest position through key positions k0, k1, k2, k2A, k3 and k4 to the end position, the analog key position signal AKP varies the potential level as shown in FIG. 5.

Turning back to FIG. 3, the solenoid-operated actuators 12*b* are placed at the back of the balance rail 10*n*, and each of the solenoid-operated actuator units 12*b* has a solenoid coil accommodated in a case 12*h* and a plunger 12*i* projectable from and retractable into the case 12*h*. The controller 12*c* cooperates with the key sensors 12*a* and the solenoid-operated actuators 12*b* as follows.

When a player wants to record a performance, the player instructs the controller 12*c* to record a performance. While the player is selectively depressing the black and white keys 10*d* and 10*c*, the key sensors 12*a* report present status or a motion of the associated keys to the controller 12*c*. The controller produces a set of music data codes representative of the performance, and stores it in a data recording medium such as a floppy disk. If the cushion units 11*b* are changed to the free position FP, the player confirms the original performance through the acoustic sounds. On the other hand, if the cushion units 11*b* prevent the strings 10*f* from the hammer heads 10*jd*, the player hears the electronic sounds through the headphone 12*d* and/or the speaker system 12*e*.

When the player instructs the controller 12*c* to reproduce the original performance, the controller 12*c* fetches the music data codes, and selectively supplies driving current signals DR to the solenoid-operated actuators 12*b*. When the solenoid coil is energized with the driving current signal DR, the plunger 12*i* upwardly projects from the case 12*h*, and causes the associated key 10*c*/10*d* to turn as if the player depresses it. The key 10*c*/10*d* actuates the associated key action mechanism 10*h*, and the key action mechanism 10*h* drives the hammer assembly 10*h* for rotation. The hammer head 10*jd* strikes the associated string 10*f*, and the vibrating string 10*f* generates the acoustic sound.

Figure 6:
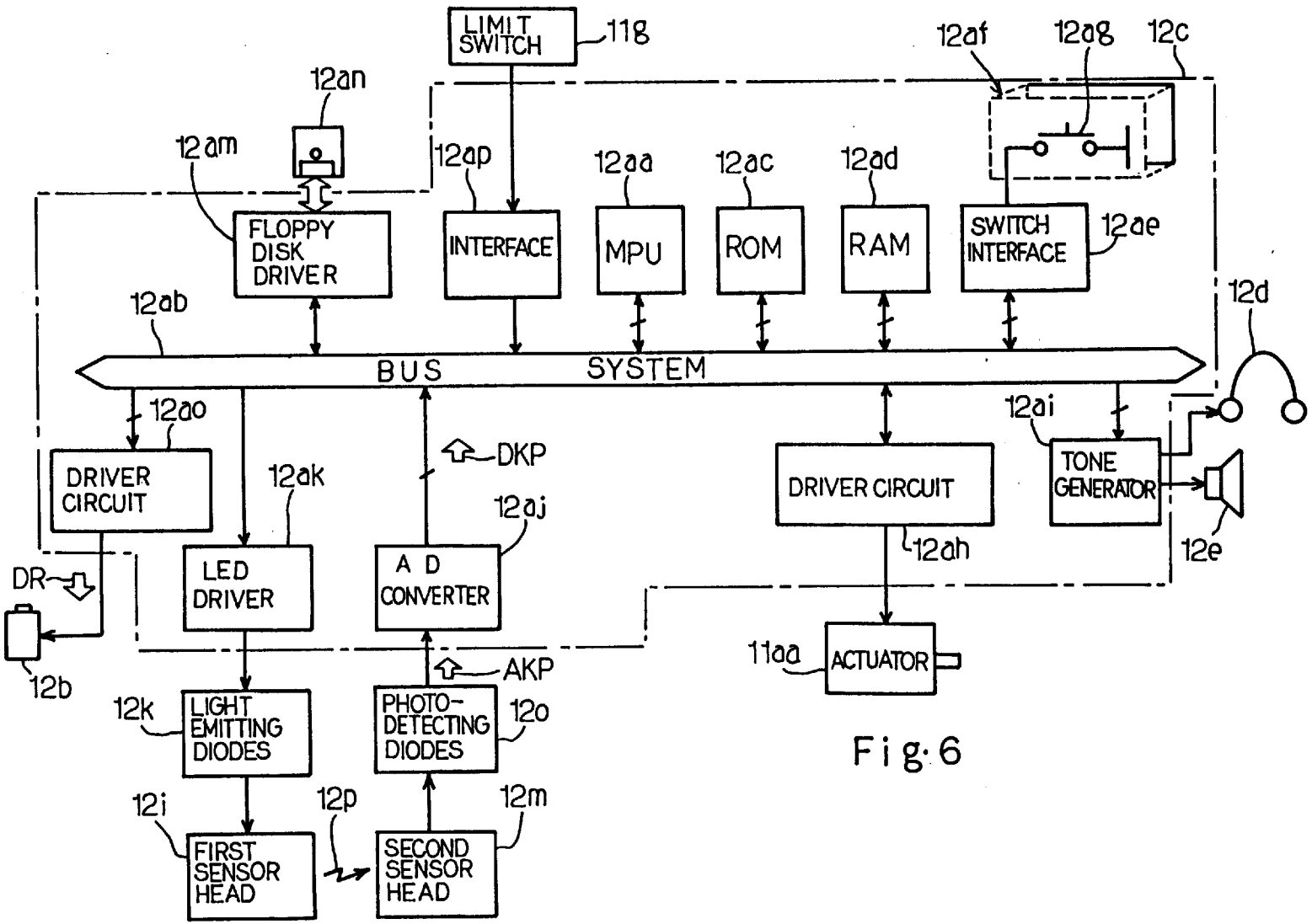
FIG. 6 is a block diagram showing the circuit arrangement of a controller incorporated in the keyboard musical instrument.

Turning to FIG. 6 of the drawings, the controller 12*a* includes a microprocessor 12*aa* abbreviated as "MPU", and the microprocessor 12*aa* is communicable with other components through a bus system 12*ab*.

A read only memory, which is abbreviated as "ROM", 12*ac* is connected to the bus system 12*ab*, and programmed instruction codes and various tables are stored in the read only memory 12*ac*. Some tables are available for producing the music data codes, and other tables are used in a generation of the driving current signals AKP.

A random access memory 12*ad* is further connected to the bus system 12*ab*, and is abbreviated as "RAM". The random access memory serves as a working memory, and the microprocessor 12*aa* assigns several memory areas to tables. Another memory area is assigned to flags.

A switch interface 12*ae* is connected between the bus system 12*ab* and a switching panel 12*af*, and a player instructs the silent system 11 to change the cushion units 11*b* between the free position FP and the blocking position BP through one 12*ag* of the switches on the panel 12*af*. Other switches may be assigned to a volume, a selection of operation mode and a selection of a timbre for the electronic sounds.

The microprocessor 12*aa* periodically scans the switch interface 12*ae* to see whether or not any one of the switches is manipulated by a player. If the microprocessor 12*aa* acknowledges the manipulation of the switch 12*ag*, the microprocessor 12*aa* checks a flag indicative of the present status of the silent system 11, and instructs a driver circuit 12*ah* to control the actuator 11*aa* through the driving current. If the flag was indicative of the free position, the driver circuit 12*ah* controls the actuator 11*aa* so as to change the cushion units 11*b* to the blocking position BP. On the other hand, when the cushion units 11*b* were in the blocking position, the driver circuit 12*ah* controls the actuator 11*aa* so as to change the cushion units 11*b* to the free position FP.

A tone generator 12*ai* is further connected to the bus system 12*ab*, and the microprocessor 12*aa* sequentially supplies the music data codes through the bus system 12*ab* to the tone generator 12*ai*. The music data codes are representative of a key-code assigned to a depressed/released key 10*c*/10*d*, a key velocity corresponding to the intensity of an impact of the hammer head 11*jd* against the string 10*f*, a key-on indicative of depressing a key and a key-off indicative of releasing a key. When the music data code indicative of the key code and the key-on, the tone generator 12*ai* forms an envelop of the audio signal, i.e., the attack, the decay and the sustain, and controls the release depending upon a release rate. The amplitude of the audio signal is controlled on the basis of the volume specified through the manipulation of the switch on the panel 12*af*. The tone generator 12*ai* has sixteen channels, and sixteen electronic sounds are concurrently produced through the headphone 12*d* and/or the speaker system 12*e* at the maximum.

An analog-to-digital converter 12*aj* is further connected to the bus system 12*ab*, and the abbreviation "A/D" stands for the term "analog-to-digital" in FIG. 6. The analog-to-digital converter 12*aj* converts the analog key position signals AKP to corresponding digital key position signals DKP, and the microprocessor 12*aa* periodically fetches the digital key position signals DKP to see whether or not any one of the black and white keys 10*c*/10*d* changes the present key position as will be described hereinbelow.

An LED driver 12*ak* is further connected to the bus system 12*ab*, and the microprocessor 12*aa* periodically instructs the LED driver 12*ak* to successively energize the twelve photo-emitting diodes. The twelve photo-emitting diodes form in combination the light source 12*k*, and distribute the light to the first sensor heads 12*i* respectively provided for the eighty-eight keys 10*c*/10*d*. The eighty-eight key sensors 12*a* are divided into twelve key sensor groups, and the twelve photo-emitting diodes are respectively connected through the twelve bundles of optical fibers 12*j* to the twelve key sensor groups. The photo-emitting diode is expected to concurrently supplies the light to eight first sensor heads 12*i* at the maximum, and the twelve photo-emitting diodes are successively energized by the LED driver 12*ak*. Thus, the driving current causes one photo-emitting diode to generate the light once, and the eight first sensor heads 12*i* radiate the light beams 12*p* to the second sensor heads 12*m* once.

The photo-detector 12*o* is implemented by eight photo-detecting diodes shared between the twelve key sensor groups, and the eight light beams 12*p* are transferred through the optical fibers 12*n* to the eight photo-detecting diodes. The analog-to-digital converter 12*aj* includes four analog-do-digital converting units. For this reason, the eight analog key position signals AKP are split into two groups, and the four analog-to-digital converting units twice repeat the analog-to-digital conversion for the eight analog key position signals.

The microprocessor 12*aa* periodically fetches the digital key position signals DKP representative of the present key positions of the eighty-eight keys 10*c*/10*d*, and compares the digital key position signals DKP with the previous digital key position signals DKP' to see whether or not a player depresses or releases any one of the eighty-eight keys 10*c*/10*d*. If a key 10*c*/10*d* changes the key position, the microprocessor identifies the key 10*c*/10*d* from the digital key position signal DKP, and discriminates the direction of the key motion. The microprocessor 12*aa* calculates the key velocity or the release rate, and generates the music data codes representative of the key-code, the key-on/key-off and the key velocity/release rate. The microprocessor 12*aa* may uses the formats of the MIDI (Musical Instrument Digital Interface) standards for the music data codes.

A floppy disk driver 12*am* is further connected to the bus system 12*ab*. The floppy disk driver 12*am* writes the music data codes stored in the random access memory 12*ad* into the floppy disk driver 12*an* in a recording mode, and reads out the music data codes from the floppy disk 12*an* to the random access memory 12*ad* in a playback mode.

A driver circuit 12*ao* is further connected to the bus system 12*ab*, and selectively supplies the driving current signals DR to the solenoid-operated actuator units 12*b* under the control of the microprocessor 12*aa*. The microprocessor 12*aa* successively fetches the music data codes stored in the random access memory 12*ad* in the playback mode, and instructs the driver circuit 12*ao* to supply or stop the driving current signal to the solenoid-operated actuator unit 12*b* associated with the key 10c/10d identified by the key code. The driving circuit 12*ao* varies the magnitude of the driving current signal DR in dependent on the key velocity.

An interface 12*ap* is coupled between the bus system 12*ab* and the limit switches 11*g*, and reports the entry into the free position/blocking position to the microprocessor 12*aa*.

The keyboard musical instrument according to the present invention behaves as follows.

Determination of Thresholds

As described hereinbefore, the key sensor 12*a* decreases the potential level of the analog key position signal AKP together with the stroke of the associated key 10*c*/10*d* from the rest position, and increases the potential level of the analog key position signal AKP on the way from the end position toward the rest position. The digital key position signal DKP similarly changes the binary value.

Reference points are provided on the path of each key 10*c*/10*d*, and the microprocessor 12*aa* individually determines thresholds for the reference points. If the digital key position signal DKP is equal to the threshold for a reference point, the microprocessor 12*aa* acknowledges that the key reaches the reference point.

When the digital key position signal DKP reaches the thresholds, the microprocessor 12*aa* acknowledges the entries of particular key state. The microprocessor 12*aa* further calculates the key velocity on the basis of times when the digital key position signal DKP exceeds the thresholds of selected reference points.

Figures 7, 12:
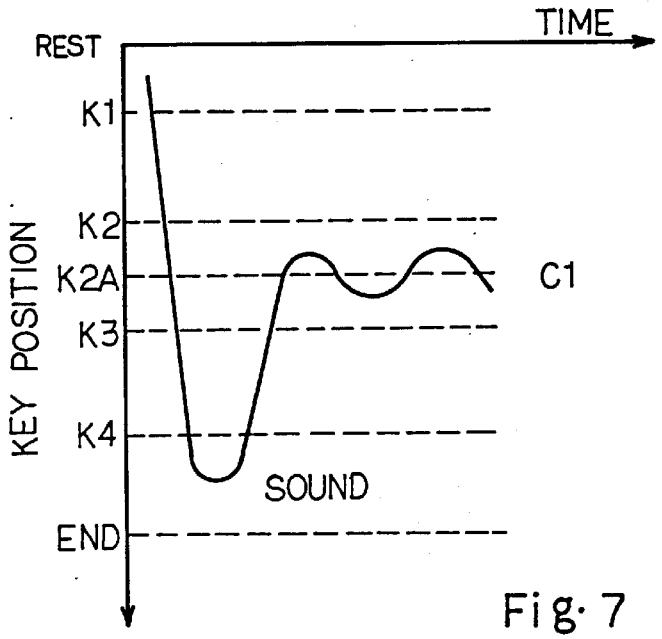
FIG. 7 is a graph showing a trajectory of a depressed key.
FIG. 12 is a view showing a built-in register array incorporated in the microprocessor.

FIG. 7 illustrates a trajectory of a depressed key, and ordinarily depressed keys usually trace the trajectory. The depressed key varies the key position along plots C1, and k1, k2, k2A, k3 and k4 are indicative of the reference points provided on a path of the depressed key. The microprocessor 12*aa* uses the reference points k1, k2, k2A, k3 and k4 for determination of the key state, and the reference point k2A is important for controlling the envelop after the release of the key.

When the controller 12*c* is powered, the microprocessor 12*aa* initializes the random access memory 12*ad* and other available registers, and starts an assignment of thresholds. The initialization and the assignment of thresholds are corresponding to steps ST1 and ST2 in a main routine program described hereinlater in detail.

The microprocessor 12*aa* sequentially fetches every four digital key position signals DKP at the output port of the analog-to-digital converter 12*aj*. The data fetch for every four digital key position signals DKP is carried out through one of detecting channel "0" to detecting channel "23". The eighty-eight keys 10*c*/10*d* form in combination the keyboard 10*a*, and detecting channel "0" to detecting channel "21" theoretically allow the microprocessor 12*aa* to fetch the digital key position signals DKP for the eighty-eight keys 10*c*/10*d*, because 22×4 is 88. However, the controller 12*c* is designated that 0 to 95 scanning points form a single scanning cycle, and, accordingly the twenty-four detecting channels are incorporated in the controller 12*c*.

When the controller 12*c* is powered, all of the black and white keys 10*c*/10*d* are maintained at the rest positions, respectively, and the microprocessor 12*aa* assigns the thresholds to the reference points k1, k2, k2A, k3 and k4 for each key. In this instance, the microprocessor 12*aa* firstly reads the binary value Xr of the digital key position signal DKP, and multiplies the binary value Xr by predetermined factors r1, r2, r2A, r3 and r4. Therefore, the thresholds K1, K2, K2A, K3 and K4 are given by equations 1 to 5.

$$K1=Xr\times r1 \quad \text{equation 1}$$

$$K2=Xr\times r2 \quad \text{equation 2}$$

$$K2A=Xr\times r2A \quad \text{equation 3}$$

$$K3=Xr\times r3 \quad \text{equation 4}$$

$$K4=Xr\times r4 \quad \text{equation 5}$$

The reference points k1, k2, k2A, k3 and k4 are selected in such a manner as to well discriminate key motions from one another, and factors r1, r2, r2A, r3 and r4 are experimentally determined for each of the white and black keys 10*c*/10*d*, respectively. The microprocessor 12*aa* transfers eighty-eight sets of thresholds K1 to K4 to the random access memory 12*ad*, and the eighty-eight sets of thresholds K1 to K4 are stored in one of the memory areas of the random access memory 12*ad* previously assigned thereto.

The thresholds K1 to K4 are representative of the actual positions of the reference points k1 to k4, respectively, and the microprocessor 12*aa* automatically determines the thresholds on the basis of the actual rest position upon completion of the initialization. Even if the rest position of a key is deviated from a design point, the microprocessor 12*aa* takes the error into account, and individualizes the thresholds K1 to K4 to the actual black and white keys 10*c*/10*d*.

Data Information Stored in RAM

Figure 8:
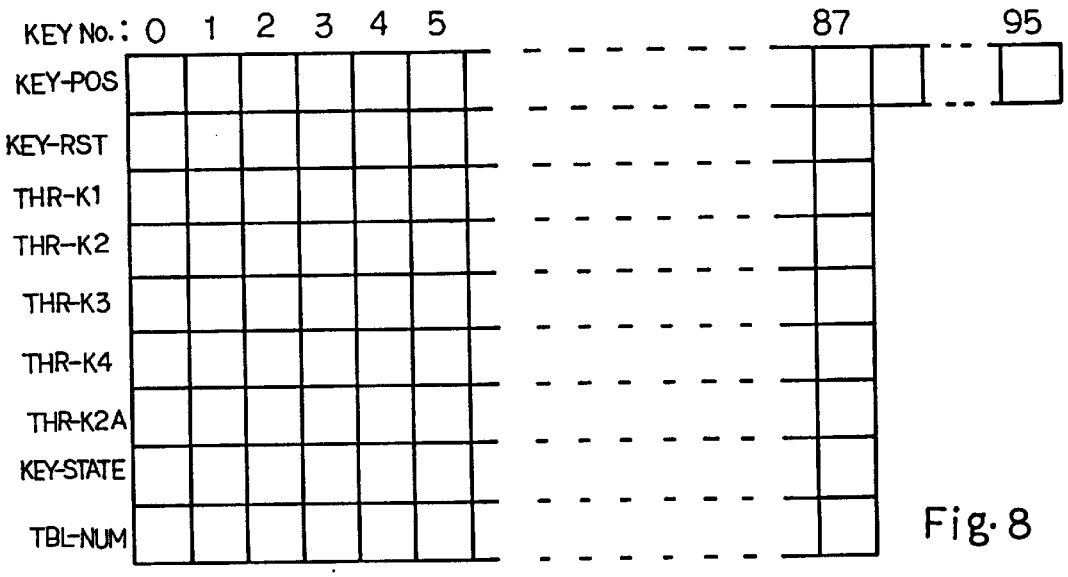
FIG. 8 is a view showing a memory area of a random access memory assigned to a key status table.

FIG. 8 illustrates the memory area assigned to a key status table, and the key status table has data storage areas assigned to the eighty-eight keys 10*c*/10*d*, respectively. Although the data storage areas of the first row KEY-POS are numbered from "0" to "95", the keyboard 10*a* contains the eighty-eight keys 10*c*/10*d*, and key number "0" the key number "87" are assigned to the black and white keys 10*c*/10*d*, respectively.

The second row "KEY-RST" is assigned to pieces of positional information representative of the rest positions of the black and white keys 10*c*/10*d*, and the microprocessor 12*aa* writes the binary values of the digital key position signals DKP into the second row "KEY-RST".

The third row to the seventh row THR-K1 to THR-K2A are respectively assigned to pieces of positional information representative of the thresholds K1, K2, K3, K4 and k2A calculated as described hereinbefore. When the microprocessor 12*aa* calculates the thresholds K1, K2, K3, K4 and K2A for each key, the microprocessor 12*aa* transfers the thresholds K1 to K2A to the random access memory 12*ad*, and writes the thresholds K1 to K2A into the memory area corresponding to the third to seventh rows.

The eight row "KEY-STATE" is assigned to pieces of status information for the eighty-eight keys 10*c*10*d*, and the ninth row "TBL-NUM" is assigned to pieces of control data information representative of table numbers of tone generation control tables. As described hereinbefore, the tone generator 12*ai* has sixteen channels, and the sixteen channels are respectively accompanied with the tone generation control tables "0" to "15". The audio signal is tailored on the basis of the pieces of control data information stored in the tone generation control table specified by the table number in the ninth row "TBL-NUM".

Figure 9:
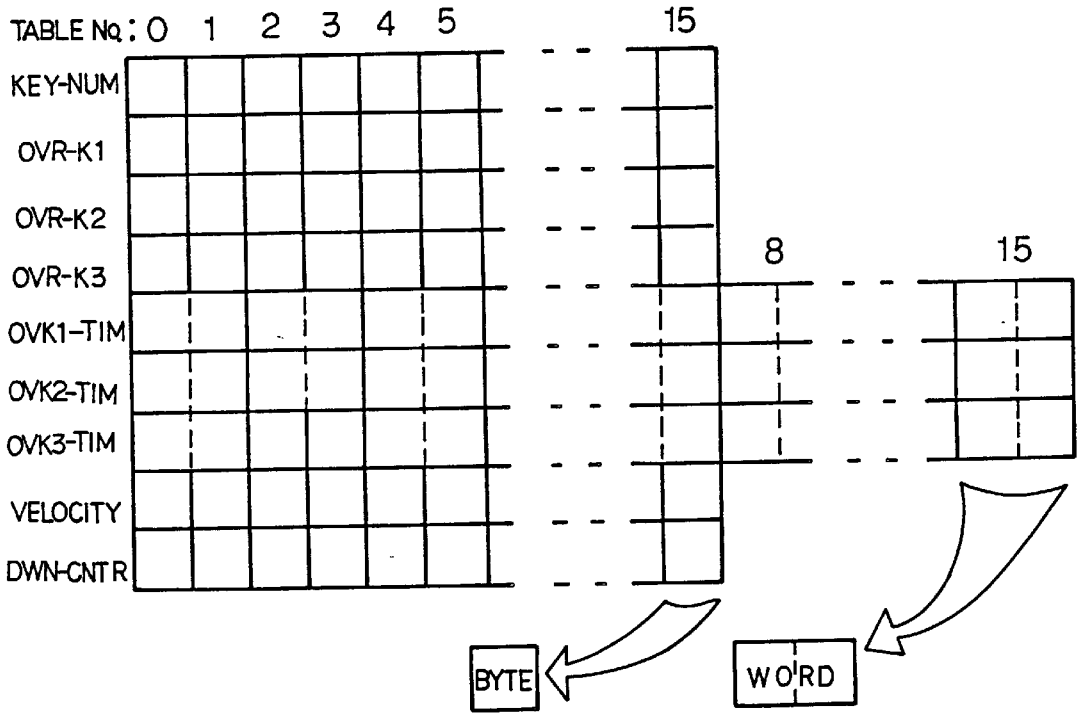
FIG. 9 is a view showing another memory area of the random access memory assigned to tone generation control tables.

The tone generation control tables are stored in another memory area of the random access memory 12*ad*, and FIG. 9 illustrates the data storage areas of the tone generation control tables. Data are written into the data storage areas of the tone generation control tables through a data processing described hereinlater. The sixteen tone generation control tables are respectively assigned table numbers from "0" to "15", and the first row "KEY-NUM" is assigned to pieces of control data information indicative of the key numbers respectively assigned to the channels.

The second to fourth rows are assigned to pieces of positional data information representative of the actual positions of a depressed key when the microprocessor 12*aa* acknowledges each key passing the thresholds K1, K2 and K3. The fifth to seventh rows are assigned to pieces of time data information representative of times when the microprocessor 12*aa* acknowledges each depressed key passing the thresholds K1, K2 and K3. The microprocessor 12*aa* periodically scans the output port of the analog-to-digital converter 12*aj*, and successively fetches the digital key position signals DKP for the eighty-eight keys. For this reason, the time when the key actually passes the threshold is not always matched with the time when the microprocessor 12*aa* fetches the digital key position signal indicative of the pass at the threshold, and the pieces of positional data information is paired with the piece of time data information, and both are written into the tone generation control table. Each of the piece of time data information is two bytes long or a word.

The eighth row "VELOCITY" is assigned to pieces of velocity data information each representative of a hammer velocity calculated for each depressed key, and the ninth row "DWN-CNTR" is assigned to pieces of time data information each representative of a time interval until a tone generation.

Determination of Hammer Velocity and Time Interval

The microprocessor 12*aa* firstly calculates a normalized displacement ND as follows.

$$ND=(d1-d2)\times 2^8/(\text{rest position})\times 2^8 \qquad \text{equation 6}$$

where d1 is a key position passing the threshold Ki (i=1, 2, or 3) and d2 is a key position passing the threshold Kj (j=2, 3 or 4 and j>i ). The reason whey d2 is subtracted from d1 is that the normalized displacement ND is decremented from the rest position toward the end position. The divisor "rest position" normalizes the displacement, and $2^8$ matches the bit string representative of the normalized displacement with the bit string representative of the pieces of time data information stored in the tone generation control tables.

Subsequently, the microprocessor 12*aa* calculates the key velocity KV, and the key velocity KV is given by equation 7.

$$KV=(\text{normalized displacement})/\{t2-t1)\times 2^8\} \qquad \text{equation 7}$$

where t1 is the time passing the threshold Ki and t2 is the time passing the threshold Kj. The divisor "$2^8$ changes the piece of velocity data information from a two-byte data to a single byte data.

The microprocessor 12*aa* accesses a converting table TB2 stored in the read only memory 12*ac*. The converting table TB2 defines the relation between the key velocities and hammer velocities, and corrects the error due to the non-linear characteristics of the photo-couplers. The converting table TB2 outputs a hammer velocity corresponding to the key velocity standardized in MIDI. The hammer velocity is supplied to the tone generation control tables, and written into the data storage areas of the eighth row "VELOCITY".

Tables TB3-2, TB3-3 and TB3-4 store a relation between the hammer velocity and a time interval until a strike at the string 10*f* calculated on the assumption that the hammer assembly 10*j* continues the rotation at the hammer velocity. The three tables TB3-2 to TB3-4 are corresponding to the reference points k2, k3 and k4, and the hammer velocity is selectively supplied to the tables TB3-2, TB3-3 and TB3-4 depending upon the threshold Kj. The time interval is written into the data storage areas of the ninth row "DWN-CNTR" of the tone generation control tables.

When the depressed key successively passes the reference points k2, k3 and k4, the hammer velocity is repeatedly calculated, and is compared with the previous hammer velocity. If the hammer velocity is larger than the previous hammer velocity, the piece of velocity data information and the piece of time data information indicative of the time interval are rewritten in the eighth row and the ninth row, respectively. The time interval is periodically decremented. When the time interval reaches zero, the key code representative of the key number and the hammer velocity are supplied from the tone generation control table to the tone generator 12*ai*, and the tone generator 12*ai* supplies the audio signal through the channel associated with the tone generation control table.

Control Sequence

Figure 11:
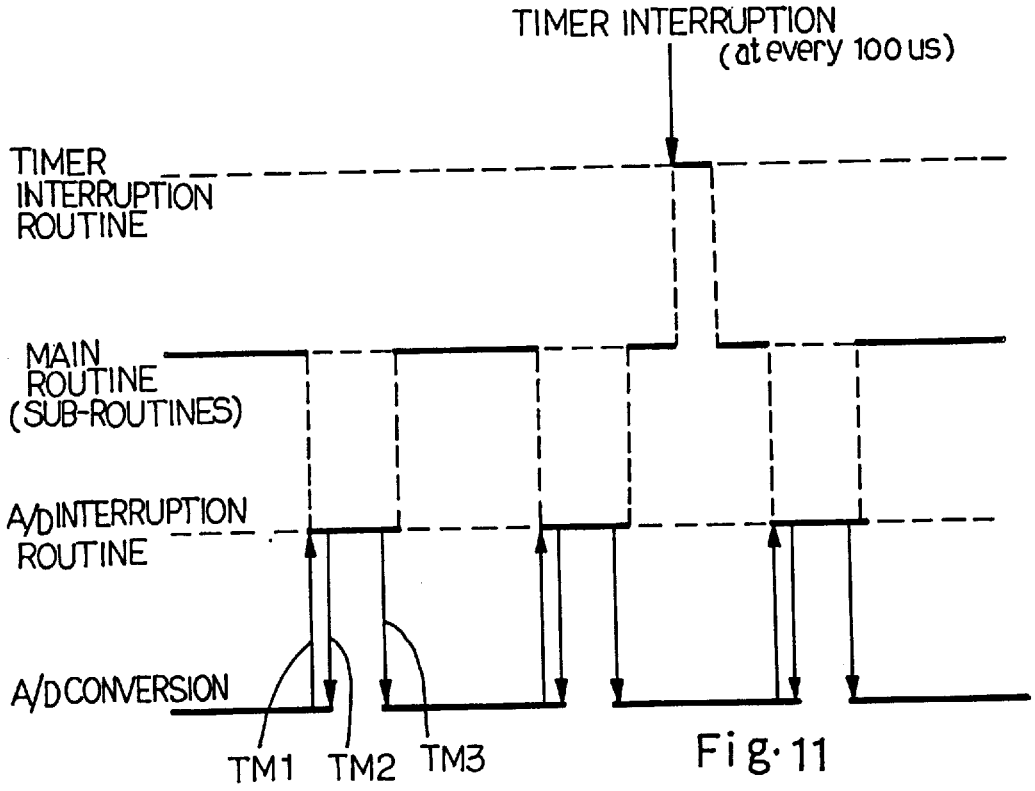
FIG. 11 is a time chart showing programs selectively executed by a microprocessor.

The microprocessor 12*aa* selectively executes a main routine program, sub-routine programs branched from the main routine program, an A/D interruption routine and a timer interruption routine. FIG. 11 illustrates the control sequence of the microprocessor 12*aa*. The microprocessor 12*aa* selectively executes the programs during periods indicated by thick bars. However, the thick bars do not exactly represent the time periods consumed by the microprocessor 12*aa*.

The microprocessor 12*aa* starts the timer interruption at every 100 micro-second. The microprocessor 12*aa* increments the lapse of time stored in a timer assigned to one of built-in registers E6 incorporated in the microprocessor 12*aa* (see FIG. 12), and decrements the time intervals stored in the tone generation control tables, if any. The microprocessor may start at the initialization, and the lapse of time is assumed to be an absolute time or the present time. The microprocessor 12*aa* starts the A/D interruption at every 1 millisecond, and fetches the digital key position signals DKP. As described hereinbefore, the microprocessor 12*aa* fetches four digital key position signals at a time. If the timer interruption and the A/D interruption are concurrently requested, the microprocessor 12*aa* gives the priority to the timer interruption, because the timer is expected to correctly indicate the lapse of time. The microprocessor 12*aa* processes the data for a tone generation through the main routine program and the associated sub-routine programs.

Register Array

As described hereinbefore, the built-in register E6 is assigned the timer. Twenty-one registers E0–E6, R0H–R6H and R0L–R6L form in combination the built-in register array, and other six built-in registers are assigned jobs as follows.

The register E5 is assigned to a time of the A/D conversion, and the key state is stored in the register R3H. The registers R3L to R6L respectively store a present key position, a table number assigned to the key to be targeted, a key number targeted by the microprocessor 12*aa* and a channel for the A/D conversion. The others E0–E4, R0H–R2H, R4H–R6H and R0L–R2L are general-purpose registers.

Timer Interruption Routine

Figure 13:
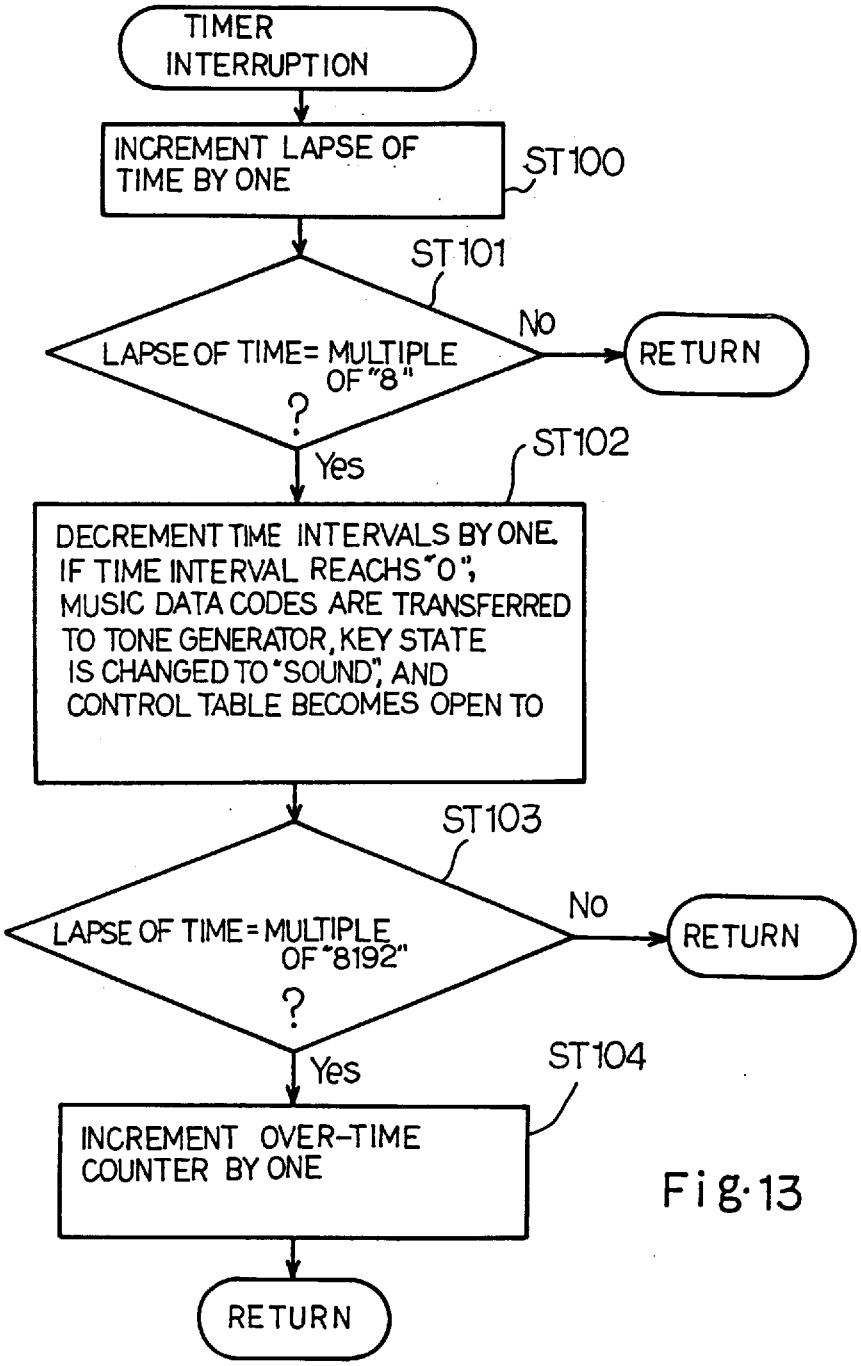
FIG. 13 is a flow chart showing a timer interruption routine program executed by the microprocessor.

FIG. 13 illustrates the program sequence of the timer interruption routine. The timer interruption takes place at every 100 micro-second. Then, the microprocessor 12*aa* is branched from the main routine program, and enters into the timer interruption routine program. The microprocessor 12*aa* firstly increments the lapse of time stored in the timer by one as by step ST100, and checks the lapse of time to see whether or not the lapse of time is equal to a multiple of 8 as by step ST101. If the answer at step ST10 is given negative, the microprocessor 12*aa* returns to the main routine program. Thus, the microprocessor 12*aa* increments the lapse of time at every timer interruption, and the lapse of time is incremented by 100 micro-second at every timer interruption.

The answer at step ST101 is given affirmative at every 800 micro-second, and the microprocessor 12*aa* proceeds to step ST10. The microprocessor 12*aa* decrements the time intervals stored in the tone generation control tables, and checks the time intervals to see whether or not any one of the time intervals reaches zero. If there is a time interval decreased to zero, the microprocessor 12*aa* transfers the music data codes representative of the key code, the key-on and the hammer velocity to the tone generator 12*ai*, and writes key status "SOUND" to the eighth row "KEY-STATE" for the key. The key status "SOUND" represents that the tone generator is now producing the electronic sound for the key. The microprocessor 12*aa* clears the ninth row "TBL-NUM" for the key, and makes the tone generation control table storing the time interval decreased to zero open to a newly depressed key. The tone generator 12*ai* is allowed to tailor the audio signal on the basis of the music data codes.

The microprocessor 12*aa* proceeds to step ST103, and checks the timer to see whether or not the lapse of time is equal to a multiple of 8192. If the answer is given negative, the microprocessor 12*aa* returns to the main routine program.

The answer at step ST103 is given affirmative at every 819.2 millisecond, and the microprocessor 12*aa* increments an over-time counter by one as by step ST104. The over-time counters are respectively provided for the sixteen channels, and are assigned to a memory area of the random access memory 12*ad*. When an over-time counter reaches a predetermined value, the microprocessor 12*aa* acknowledges the present key state is continued too long. When the over-time counter is incremented, the microprocessor 12*aa* returns to the main routine program.

A/D Interruption Routine

Figure 14:
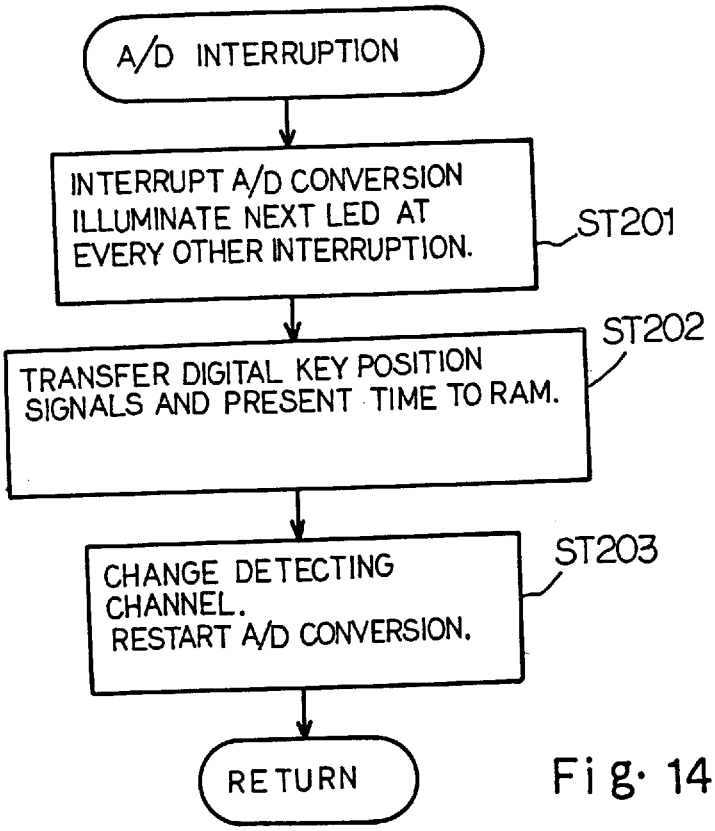
FIG. 14 is a flow chart showing an A/D interruption routine program executed by the microprocessor.

FIG. 14 illustrates the A/D interruption routine program. The analog-to-digital converter 12*aj* converts the analog key position signals AKP independently of the microprocessor 12*aa*. When the analog-to-digital converter 12*aj* converts four analog key position signals AKP to the corresponding digital key position signals DKP, the analog-to-digital converter 12*aj* requests an interruption to the microprocessor 12*aa*, and the microprocessor 12*aa* enters into the A/D interruption routine program.

Figure 15:
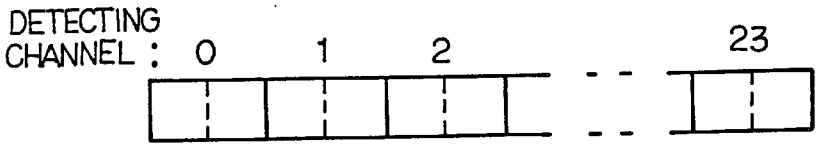
FIG. 15 is a view showing a table for storing detecting times at detecting channels.
Figure 10:
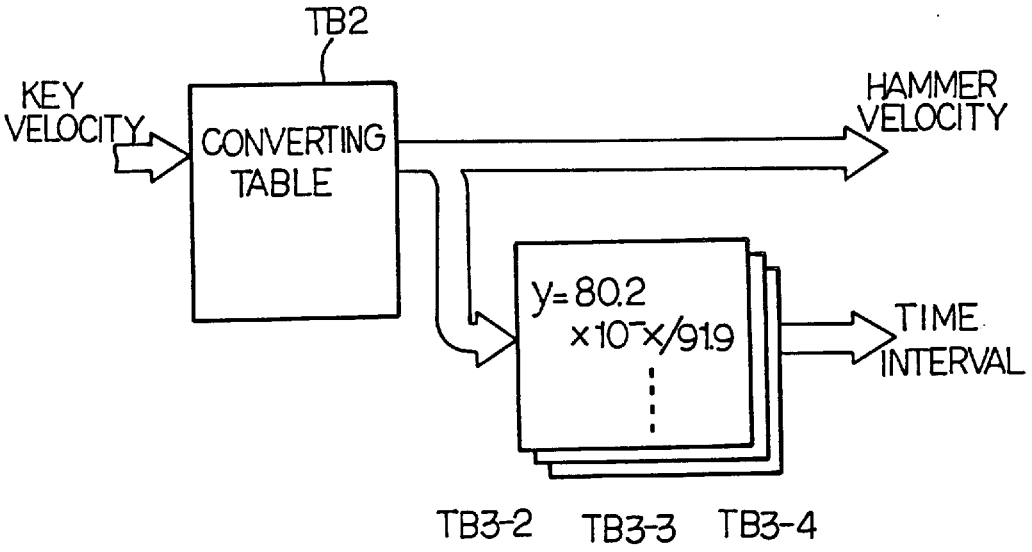
FIG. 10 is a block diagram showing a converting table and tables for a time interval.

The microprocessor 12*aa* firstly interrupts the A/D conversion, and instructs the LED driver 12ak to supply the driving current to the next photo-emitting diode at every other interruption as by step ST201. Subsequently, the microprocessor 12*aa* fetches the four digital key position signals DKP, and writes the four digital key position signals DKP into the first row "KEY-POS" (see FIG. 8) for the four keys 10*c*/10*d*. The microprocessor 12*aa* further fetches the present time stored in the timer E6, and writes the present time into a table (see FIG. 15) assigned to one of the detecting channels "0" to "23" used for the digital key position signals DKP. The table shown in FIG. 15 is formed in the random access memory 12*ad*.

The microprocessor proceeds to step ST203, and changes the detecting channel. If the present detecting channel is the last detecting channel "23", the microprocessor 12*aa* changes the present detecting channel to the first detecting channel "0". The microprocessor 12*aa* instructs the analog-to-digital converter 12*aj* to restart the analog-to-digital conversion. In FIG. 11, timings TM1, TM2 and TM3 are representative of the A/D interruption request, the interruption of the analog-to-digital conversion and the resumption of the analog-to-digital conversion.

Main Routine Program

First, the key state is described with reference to FIG. 16. The key is assumed to be depressed at time t1. The key successively passes the reference points k1, k2, k3 and k4 at times t2, t3, t4 and t5, respectively, and reaches the end position at time t6. Plots PL1 is representative of the trajectory of the depressed key, and the trajectory is typical. The depressed key has the key state "UPPER" between the rest position and the reference point k1, and changes the key state from "UPPER" to "TOUCH-A" between the reference points k1 and k2. Thereafter, the key state is successively changed from TOUCH-A to COUNT-DOWN "0" between the reference points k2 and k3, COUNT-DOWN "0" to COUNT-DOWN "1" between the reference points k3 and k4 and COUNT-DOWN "1" to COUNT-DOWN "2" after the reference point k4. When music data codes are transferred to the tone generator 12*ai* for generating an electronic sound, the key state is changed to "SOUND".

The key is staying at the end position between time t6 and time t7, and is released at time t7. After the release, the key is assumed to pass the reference points k4, k3 and k2 at time t8, t9 and t10. The key continuously maintained in the key state "SOUND" until time t10. When the key passes the reference point k2, the microprocessor acknowledges the key-off, and changes the key state to "HOLD".

The key is depressed between the reference points K2 and k1, and is downwardly moved, again. The key, passes the reference point k2 at time t11, and the key state is changed from HOLD to TOUCH-B. The key state is changed from TOUCH-B through COUNT-DOWN "1" and COUNT-DOWN "2" to SOUND.

The key is released, and passes the reference points k4, k3 and k2 at times t15, t16 and t17. The microprocessor 12*aa* acknowledges the key-off at time t17, again, and the key enters into the key state HOLD.

The key is depressed, again, before reaching the rest position, and the microprocessor 12*aa* gives the key state TOUCH-B to the key. However, the downward key motion is so slow that the key is maintained in "TOUCH-B" over a predetermined time period. The microprocessor 12*aa* gives the key state TIME-OVER to the key. The key does not enter into the key state SOUND, and returns to the rest position.

Figure 17:
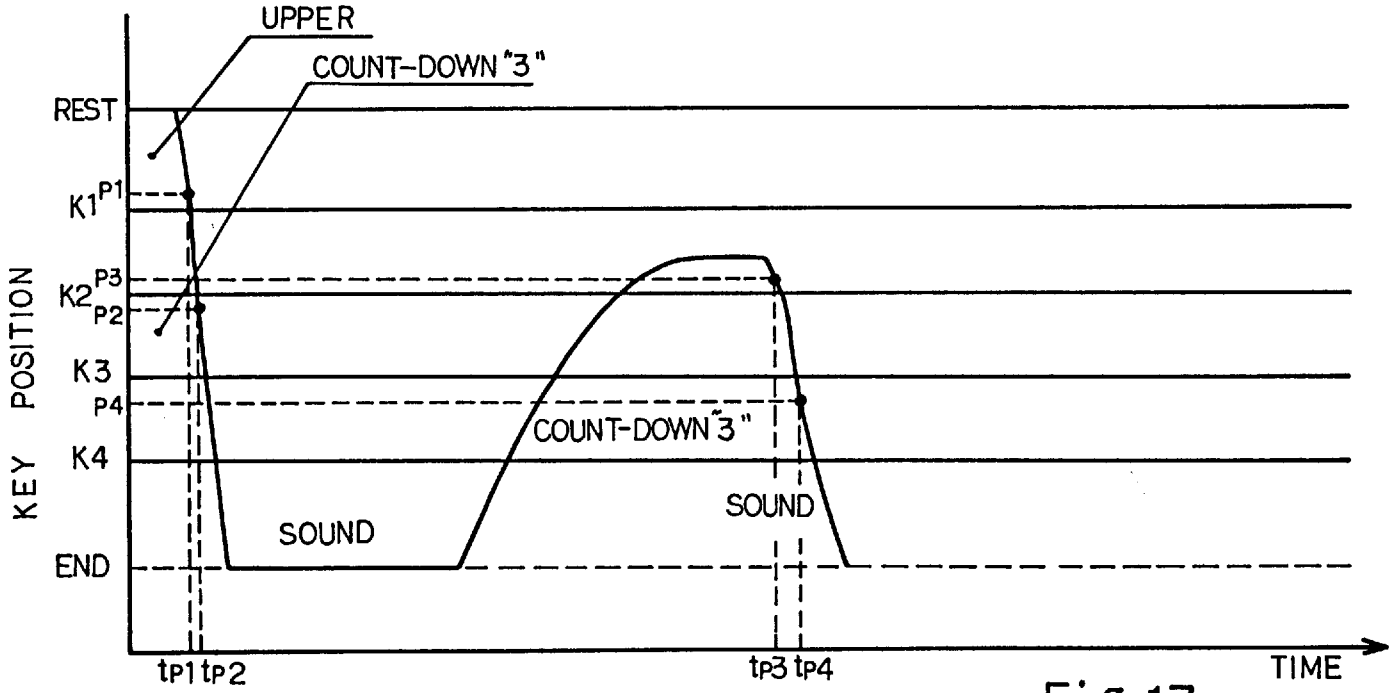
FIG. 17 is a graph showing a trajectory of key strongly depressed.

If a key is strongly depressed, the key may pass more than one reference point from the previously detected key position, and FIG. 17 illustrates such a quick key motion. The microprocessor checked the key position at time tp1, and checks the key position at time tp2, again. The player moves the key so fast that the key passes the reference points k1 and k2 between times tp1 and tp2. The microprocessor 12*aa* gives the key state COUNT-DOWN "3" to the key.

Similarly, if the key passes two reference points k2 and k3 during the periodical detection between time tp3 and tp4, the microprocessor 12*aa* gives the key state COUNT-DOWN "3" to the key.

Figure 18:
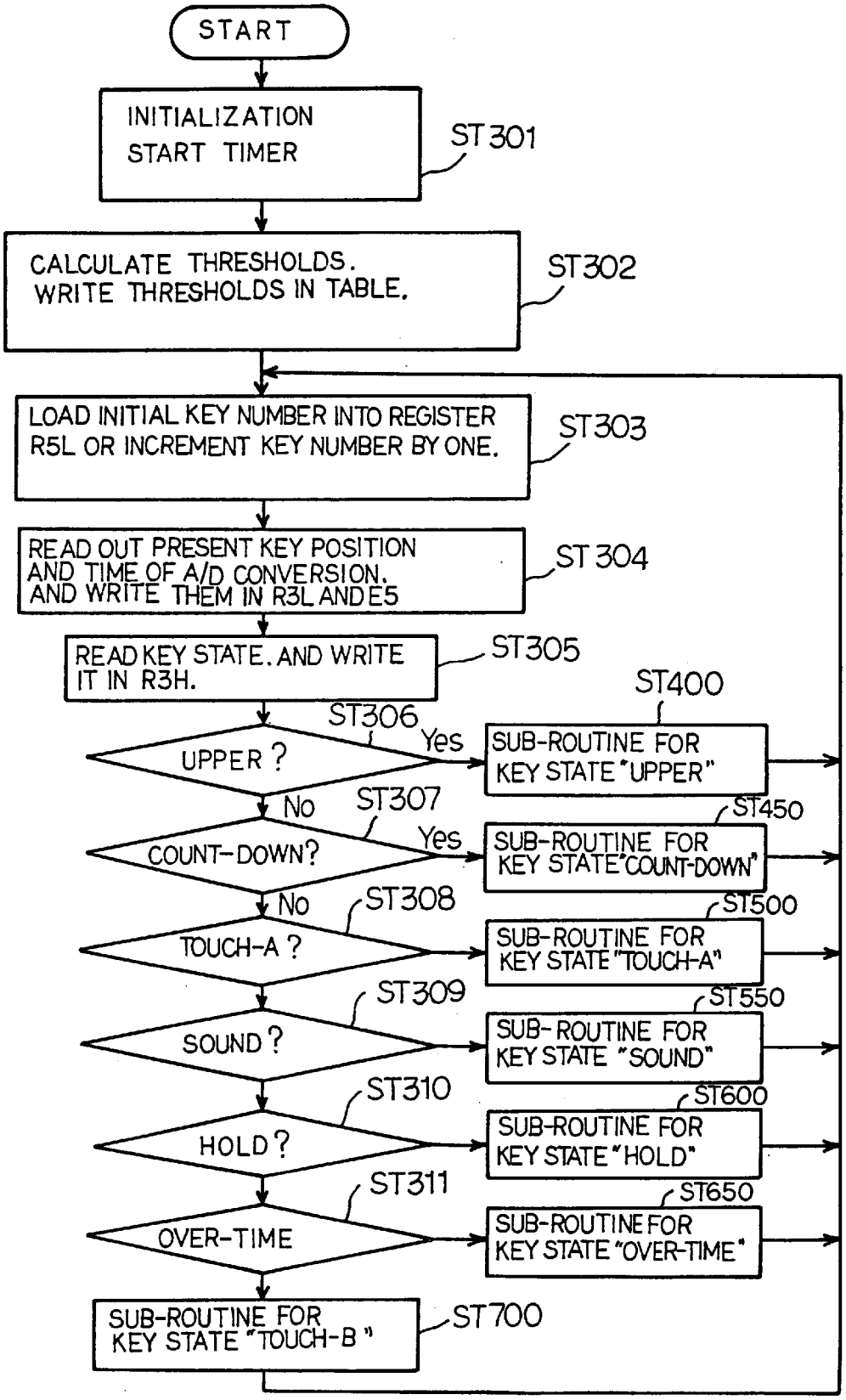
FIG. 18 is a flow chart showing a main routine program executed by the microprocessor.
Figure 19:
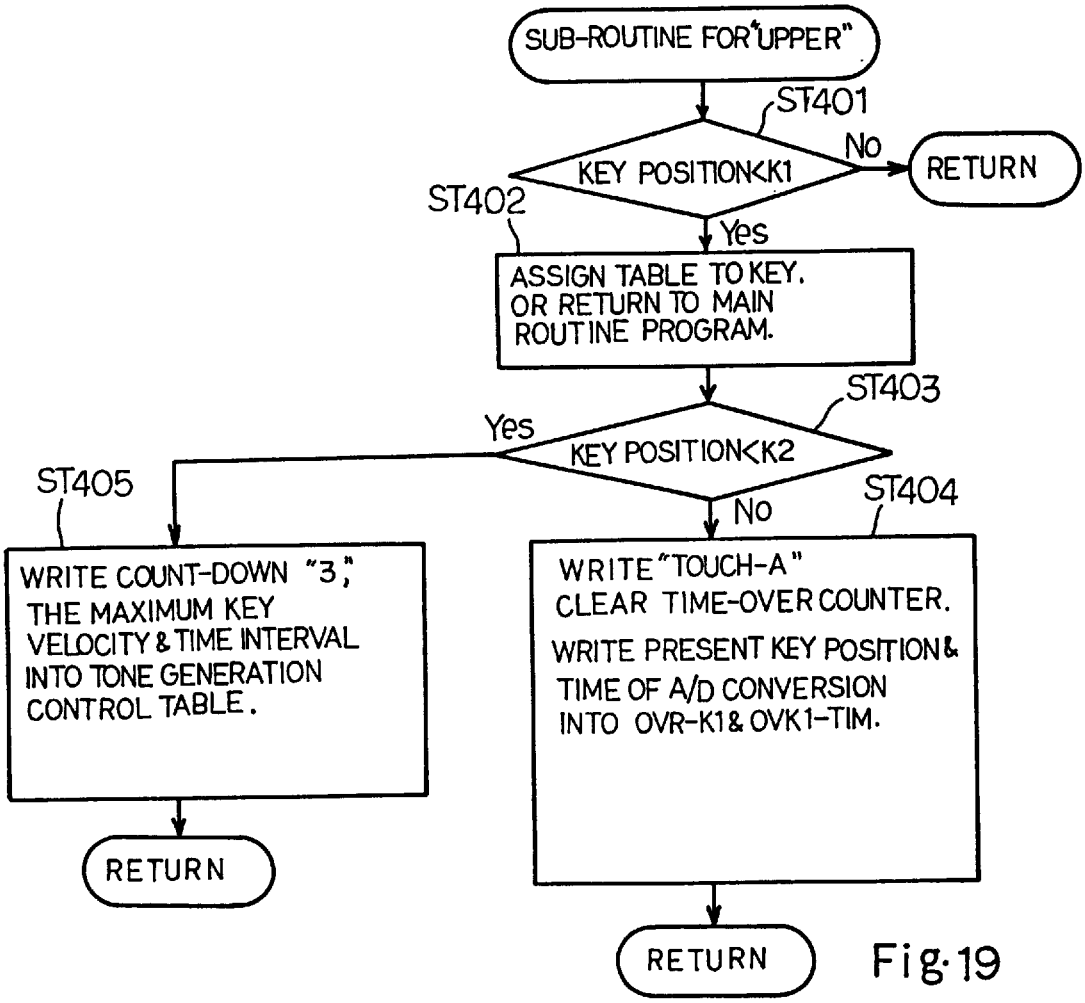
FIG. 19 is a flow chart showing a sub-routine program for key state UPPER.

FIG. 18 illustrates the main routine program. When the controller 12*c* is powered, the microprocessor 12*aa* starts the main routine program, initializes the built-in registers E0–E6, R0H–R6H and R0L–R6L and the random access memory 12*ad*, and starts the timer E6 as by step ST301. Thereafter, the microprocessor 12*aa* calculates the thresholds K1, K2, K3, K4 and K2A as described hereinbefore, and writes the thresholds K1, K2, K3, K4 and K2A into the key status table shown in FIG. 8 as by step ST302.

The microprocessor 12*aa* proceeds to step ST303. The microprocessor 12*aa* load an initial key number to be processed into the register R5L or increments the key number in the register R5L by one. If the previous key number is "87", the microprocessor 12*aa* loads the key number "0" into the register R5L, again. Thus, the key 10*c*/10*d* to be targeted by the microprocessor 12*aa* is looped between "0" and "87".

Subsequently, the microprocessor 12*aa* reads out the present key position and the time of the A/D conversion for the key to be targeted from the rows "KEY-POS" and "KEY-TIM". The present key position and the time of the A/D conversion are written into the register R3L and E5, respectively as by step ST304. The microprocessor 12*aa* has written the present key position and the time of the A/D conversion into the key status table and the table shown in FIG. 15 as described in connection with the A/D interruption routine. The microprocessor 12*aa* further reads out the key state of the key to be targeted, and write the key state into the register R3H as by step ST305. Thus, the microprocessor 12*aa* obtains the present key status for the key to be targeted, and sequentially makes decisions at steps ST306 to ST311.

The microprocessor 12*aa* firstly checks the register R3L to see whether or not the key has passed the reference point k1 . If the answer at step ST306 is given affirmative, the main routine program is branched to a sub-routine program ST400 for the key state "UPPER".

On the other hand, when the answer at step ST306 is given negative, the microprocessor 12*aa* proceeds to step ST307, and checks the register R3H to see whether or not the key has entered into the key state COUNT-DOWN "1", COUNT-DOWN "2" or COUNT-DOWN "3". If the answer at step ST307 is given affirmative, the main routine program is branched to a sub-routine program ST450 for the key state "COUNT-DOWN".

On the other hand, when the answer at step ST307 is given negative, the microprocessor 12*aa* proceeds to step ST308, and checks the register R3H to see whether or not the key has entered into the key state TOUCH-A . If the answer at step ST308 is given affirmative, the main routine program is branched to a sub-routine program ST500 for the key state "TOUCH-A".

On the other hand, when the answer at step ST308 is given negative, the microprocessor 12*aa* proceeds to step ST309, and checks the register R3H to see whether or not the key has entered into the key state SOUND. If the answer at step ST309 is given affirmative, the main routine program is branched to a sub-routine program ST450 for the key state "SOUND".

On the other hand, when the answer at step ST309 is given negative, the microprocessor 12*aa* proceeds to step ST310, and checks the register R3H to see whether or not the key has entered into the key state HOLD. If the answer at step ST310 is given affirmative, the main routine program is branched to a sub-routine program ST600 for the key state "HOLD".

On the other hand, when the answer at step ST310 is given negative, the microprocessor 12*aa* proceeds to step ST311, and checks the register R3H to see whether or not the key has entered into the key state OVER-TIME. If the answer at step ST311 is given affirmative, the main routine program is branched to a sub-routine program ST650 for the key state "OVER-TIME".

On the other hand, when the answer at step ST311 is given negative, the microprocessor 12*aa* proceeds to the sub-routine program for the key state "TOUCH-B".

After the execution of any one of the sub-routine programs 400, 450, 500, 550, 600, 650 and 700, the microprocessor 12*aa* returns to step ST303, and reiterates the loop consisting of the steps ST303–ST311 and any one of the sub-routine programs ST400–ST700.

Sub-routine Program for Key State "UPPER"

When the key has entered into the key state UPPER, the microprocessor 12*aa* enters into the sub-routine for UPPER. The microprocessor 12*aa* compares the present key position with the threshold K1, and checks the present key position stored in the register R3L to see whether or not the key has passes the reference point k1 as by step ST401. If the answer at step ST401 is given negative, the microprocessor 12*aa* admits that the key is still staying around the rest position, and returns to the main routine program.

On the other hand, when the key has passes the reference point k1, the answer at step ST401 is given affirmative, and the microprocessor 12*aa* proceeds to step ST402 checks the tone generation control tables shown in FIG. 9 to see whether or not any one of the tone generation control tables is available for the key. As described hereinbefore, the tone generator 12*ai* has sixteen channels, and, accordingly, the sixteen tone generation tables are prepared for controlling the tone generation. If one of the tone generation control tables is available for the key, the microprocessor 12*aa* assigns the table to the key, and writes the table number into the register R4L. However, if all the sixteen tone generation control tables have been already assigned to other keys, the microprocessor 12*aa* immediately returns to the main routine program.

Subsequently, the microprocessor 12*aa* compares the present key position with the threshold K2 to see whether or not the key has passed the reference point k2 as by step ST403. If the answer at step ST403 is given negative, the key is downwardly moved at a standard key velocity, and the microprocessor 12*aa* proceeds to step ST404.

At step ST404, the microprocessor 12*aa* rewrites the key state stored in the key status table from UPPER to TOUCH-A. The over-time counter associated with the tone generation control table is cleared, and the microprocessor 12*aa* writes the present key position and the time of A/D conversion stored in the registers R3L and E5 into the data storage areas OVR-K1 and OVK1-TIM of the tone generation control table.

On the other hand, when the answer at step ST403 is given affirmative, the key is downwardly moved at a high speed, and the microprocessor proceeds to step ST405. The microprocessor 12*aa* rewrites the key state stored in the key status table from UPPER to COUNT-DOWN "3", and writes "h7F" indicative of the predetermined maximum key velocity into the data storage area "VELOCITY" of the tone generation control table. The microprocessor 12*aa* determines a time interval on the basis of the maximum key velocity with reference to the table TB3-2, and writes a time interval into the data storage area "DWN-CNTR" of the tone generation control table.

The microprocessor 12*aa* returns to the main routine program after either step ST404 or ST405.

Sub-routine Program for Key State "TOUCH-A"

Figure 20:
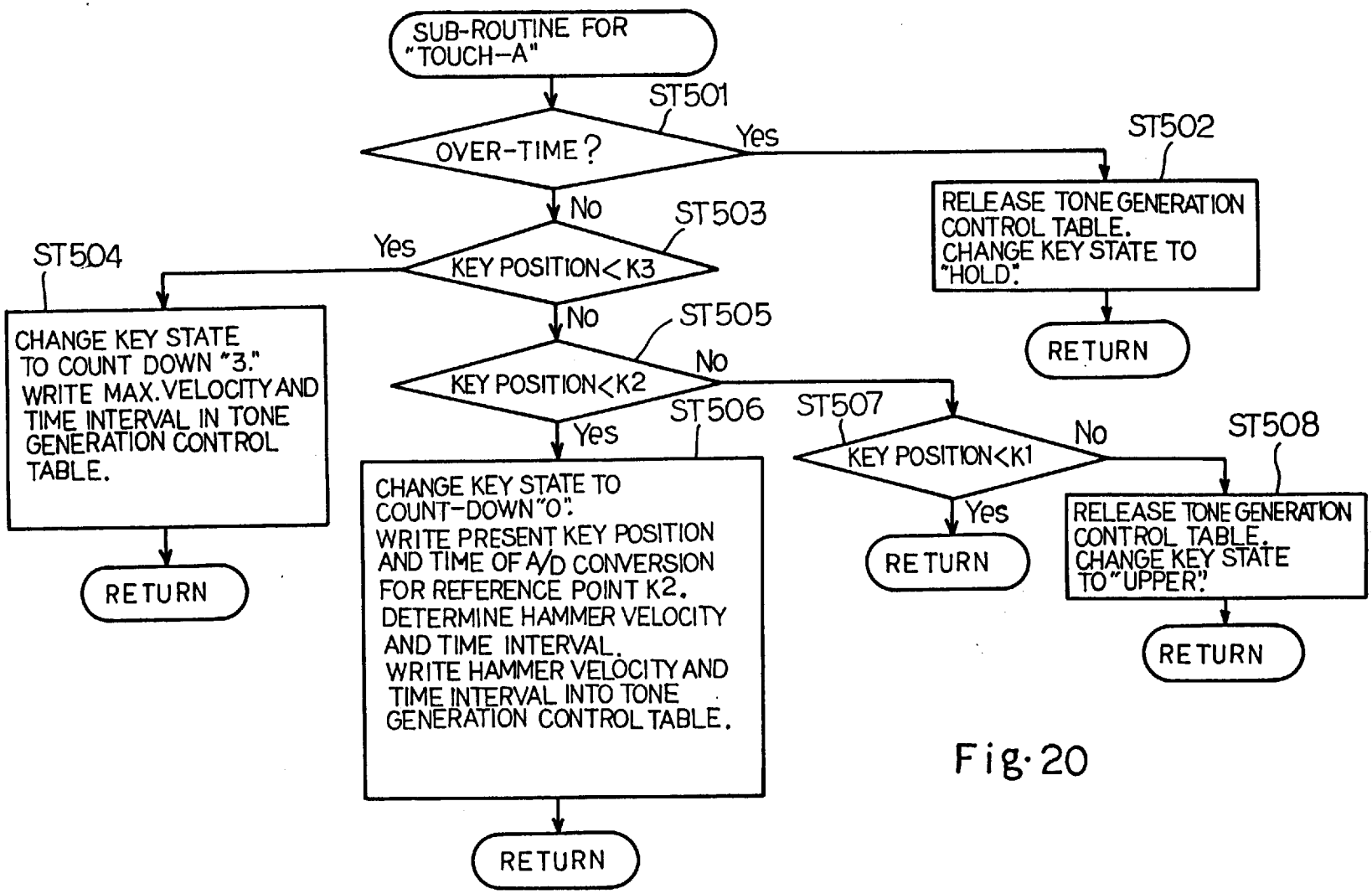
FIG. 20 is a flow chart showing a sub-routine program for key state TOUCH-A.

If the key state has been changed to TOUCH-A, the microprocessor 12*aa* enters into the sub-routine for the key state "TOUCH-A". FIG. 20 illustrates the sub-routine program for the key state TOUCH-A. The microprocessor 12*aa* checks the over-time counter to see whether or not the predetermined time period is expired as by step ST501. The over-time counter is incremented by one at every 100 microsecond (see FIG. 13), and, for this reason, the predetermined time period will be expired in so far as the counter is reset.

If the answer at step ST501 is given affirmative, the key traces the path indicated by broken lines BL1 (see FIG. 16), and the player is assumed to keep his finger on the key without further depressing. The microprocessor 12*aa* releases the tone generation control table from the assignment to the key, and changes the key state from TOUCH-A to HOLD as by step ST502. Even though the player keeps the key in the key state HOLD, the player may further depress the key (see the key motion from time t11 to time t14), and the controller 12*c* can cope with the key motion as will be described hereinlater. Thereafter, the microprocessor 12*aa* returns to the main routine program.

On the other hand, when the answer at step ST501 is given negative, the microprocessor 12*aa* checks the register R3L to see whether or not the key has passed the reference point k3 as by step ST503. If the answer at step ST503 is given affirmative, the player is assumed to accelerate the key, and the key successively passes the reference points k2 and k3 within the time period from the previous scanning as similar to the key motion between time tp3 and time tp4 (see FIG. 17). The microprocessor 12*aa* changes the key state stored in the data storage area KEY-STATE of the key status table from TOUCH-A to COUNT DOWN "3", and writes the maximum hammer velocity "h7F" and the time interval corresponding to the maximum hammer velocity into the data storage areas VELOCITY and DWN-CNTR of the tone generation control table as by step ST504. Thereafter, the microprocessor 12*aa* returns to the main routine program.

When the answer at step ST503 is given negative, the microprocessor repeats the check to see whether or not the key has passed the reference point k2 as by step ST505. If the answer at step ST505 is given affirmative, the key is tracing the plots PL1 from time t2 through time t3 (see FIG. 16), and the microprocessor 12*aa* proceeds to step ST506. The microprocessor 12*aa* changes the key state in the data storage area of the key status table from TOUCH-A to COUNT-DOWN "0", and transfers the present key position stored in the register R3L and the time of A/D conversion stored in the register E5 to the tone generation control table. The present key position and the time of A/D conversion are written into the data storage areas OVR-K2 and OVK2-TIM. The key position and the time of A/D conversion have been already written into the data storage areas OVR-K1 and OVK1-TIM (see step ST404 in the sub-routine for the key state UPPER). The microprocessor 12*aa* calculates the key velocity, and writes the hammer velocity and a time interval corresponding to the hammer velocity into the data storage areas VELOCITY and DWN-CNTR of the tone generation control table.

When the answer at step ST505 is given negative, the microprocessor checks the register R3L again to see whether or not the key is still under the reference point k1 as by step ST507. If the answer at step ST507 is given affirmative, the key is still traveling through the space between the reference points k2 and k3, and the microprocessor 12*aa* returns to the main routine program.

Figure 16:
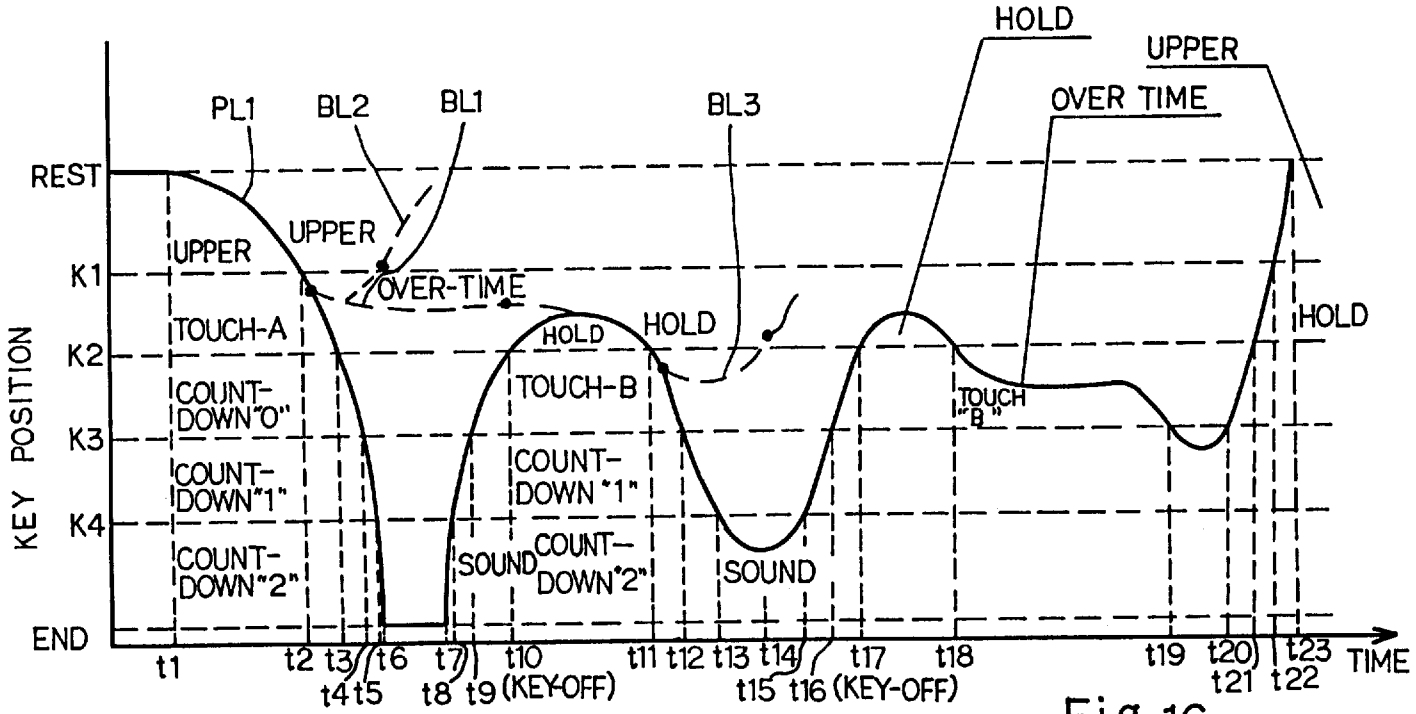
FIG. 16 is a graph showing a trajectory of key.

On the other hand, when the answer at step ST507 is given negative, the player is assumed to remove his finger from the key, and the key is upwardly moved as indicated by broken lines BL2 (see FIG. 16). The microprocessor releases the tone generation control table from the assignment to the key, and changes the key position from TOUCH-A to UPPER as by step ST508. Thereafter, the microprocessor 12*aa* returns to the main routine program.

Sub-routine Program for Key State "COUNT-DOWN"

Figure 21:
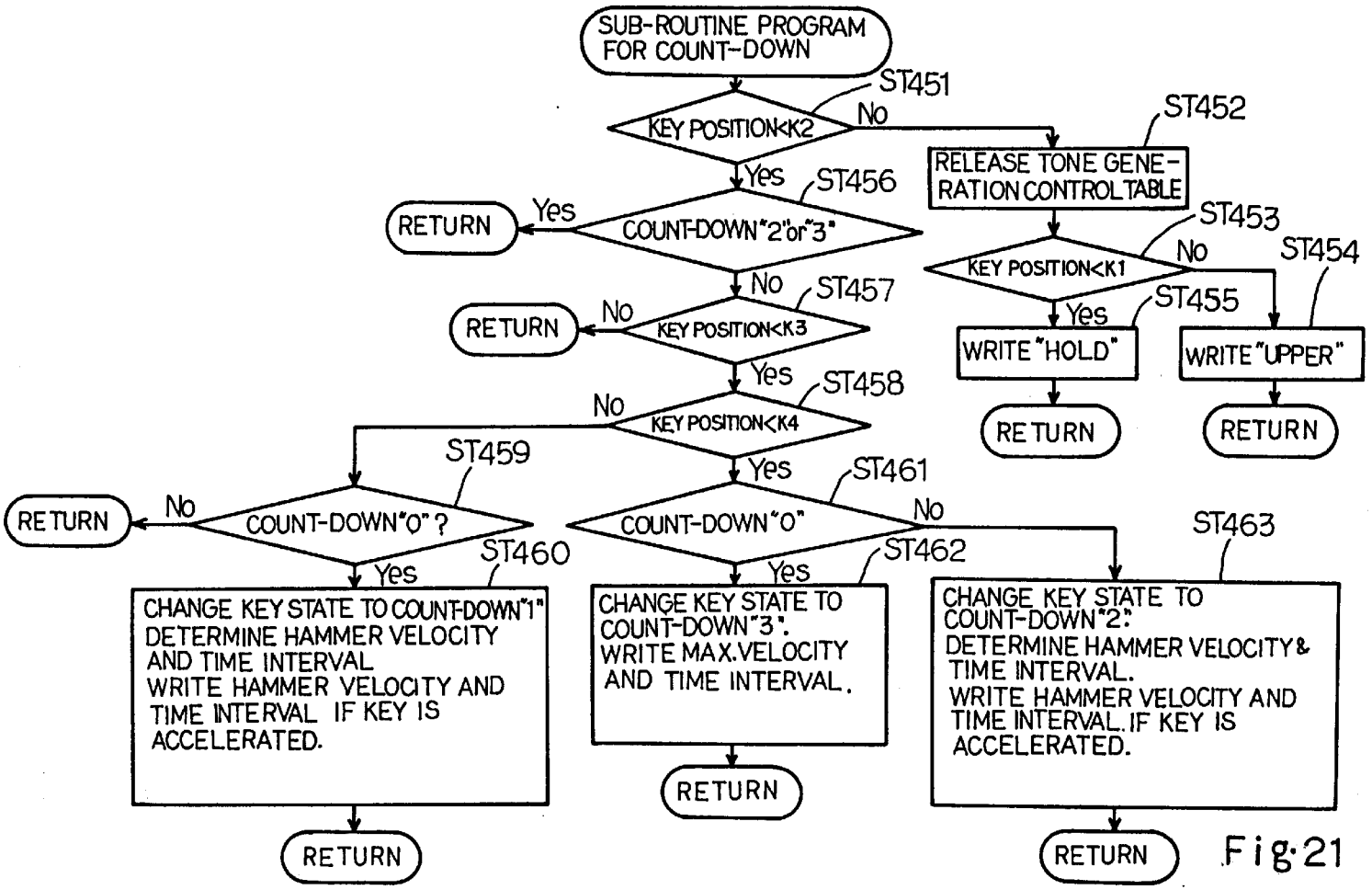
FIG. 21 is a flow chart showing a sub-routine program for key state COUNT-DOWN.
Figure 22:
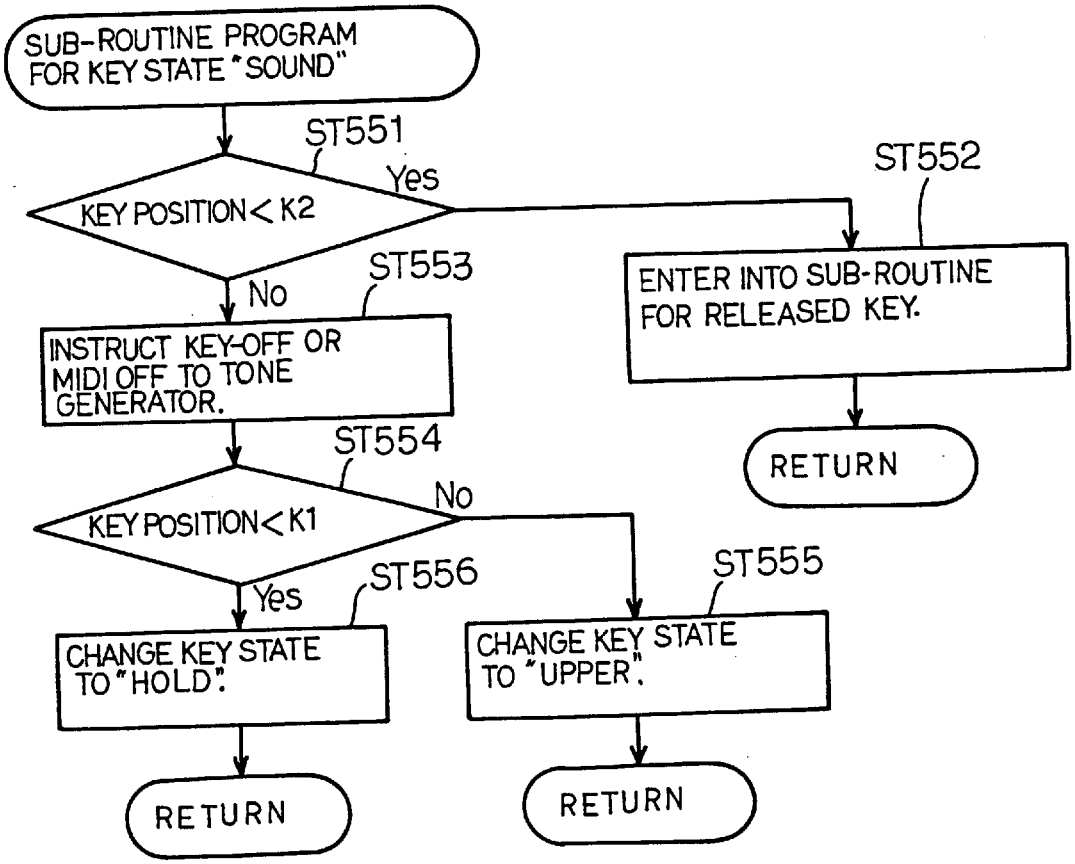
FIG. 22 is a flow chart showing a sub-routine program for the key state SOUND.
Figure 23:
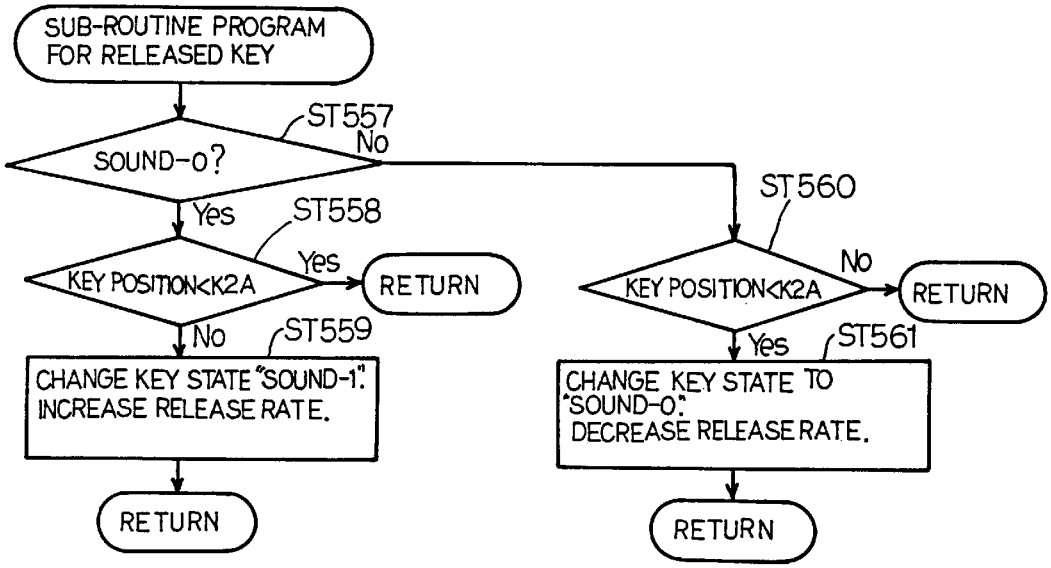
FIG. 23 is a flow chart showing a sub-routine program for a released key.

If the key state has entered into COUNT-DOWN "1", COUNT-DOWN "2" or COUNT-DOWN "3", the microprocessor 12*aa* is branched from the main routine program to the sub-routine program for the key state COUNT-DOWN shown in FIG. 21. The microprocessor 12*aa* firstly checks the register R3L whether or not the key has passed the reference point K2 as by step ST451. If the answer at step ST451 is given negative, the key returns toward the rest position, and the microprocessor 12*aa* makes the tone generation control table assigned to the key at step ST402 open to a depressed key as by step ST452.

Subsequently, the microprocessor compares the present key position with the threshold K1 to see whether or not the key is under the reference point k1 as by step ST453. If the answer at step ST453 is given negative, the key has returned to a position close to the rest position, and the microprocessor 12*aa* rewrites the key state from COUNT-DOWN "1", "2" or "3" to UPPER as by step ST454. Thereafter, the microprocessor 12*aa* returns to the main routine program. On the other hand, if the answer at step ST453 is given affirmative, the microprocessor 12*aa* rewrites the key state from COUNT-DOWN "1", "2" or "3" to HOLD as by step ST455. Thereafter, the microprocessor 12*aa* returns to the main routine program.

On the other hand, when the answer at step ST451 is given affirmative, the microprocessor 12*aa* checks the register R3H to see whether or not the key state is COUNT-DOWN "2" or COUNT-DOWN "3" as by step ST456. If the answer is given affirmative, the microprocessor 12*aa* returns to the main routine program. On the other hand, when the answer at step ST456 is given negative, the microprocessor 12*aa* checks the register R3L to see whether or not the key has passed the reference point K3 as by step ST457. If the answer at step ST457 is given negative, the key is still between the reference points k2 and k3, and the microprocessor 12*aa* returns to the main routine program.

On the other hand, when the answer at step ST457 is given affirmative, the microprocessor 12*aa* compares the present key position with the threshold K4 to see whether or not the key has downwardly passed the reference point k4 as by step ST458. If the answer at step ST458 is given negative, the microprocessor checks the register R3H to see whether or not the key state is COUNT-DOWN "0" as by step ST459. If the answer at step ST459 is given affirmative, the key passes the next reference point, and enters into the key state COUNT-DOWN "1". Accordingly, the microprocessor 12*aa* rewrites the key state from COUNT-DOWN "0" to COUNT-DOWN "1", and determines the hammer velocity between the reference points k1 and k3 and the time interval corresponding thereto as by step ST460. If the new hammer velocity is larger than the hammer velocity stored in the tone generation control table, the key is accelerated, and the microprocessor 12*aa* writes the new hammer velocity and a corresponding time interval into the data storage areas VELOCITY and DWN-CNTR of the tone generation table. Thereafter, the microprocessor 12*aa* returns to the main routine program. The tone generation control table stores the key position and the time for the reference point k1, and the registers R3L and E5 stores the present key position and the present time for the reference point k3. On the other hand, when the answer at step ST459 is given negative, the key is still within the key state COUNT-DOWN "*1*", and the microprocessor 12*aa* returns to the main routine program.

When the answer at step ST458 is given affirmative, the microprocessor 12*aa* also checks the register R3H to see whether or not the key state is COUNT-DOWN "0" as by step ST461. If the answer at step ST461 is given affirmative, the key has passes the reference points k3 and k4, and the microprocessor 12*aa* proceeds to step ST462. The microprocessor 12*aa* rewrites the key state to COUNT-DOWN "3" in the data storage area KEY-STATE of the key status table, and changes the hammer velocity and the time interval in the tone generation control table to the maximum values. Thereafter, the microprocessor 12*aa* returns to the main routine program.

When the answer at step ST461 is given negative, the microprocessor proceeds to step ST463. The microprocessor 12*aa* changes the key state to COUNT-DOWN "2", and determines the hammer velocity and the time interval corresponding thereto on the basis of the key positions and the times at the reference points k2 and k4. If the new hammer velocity and the new time interval are larger than the hammer velocity and the interval stored in the tone generation table, the key is accelerated, and the microprocessor 12*aa* rewrite the data storage areas VELOCITY and DWN-CNTR to the new hammer velocity and the new time interval. The key position and the time at the reference point k2 are read out from the tone generation control table, and the registers R3L and E5 store the key position and the time at the reference point k4. After step ST463, the microprocessor 12*aa* returns to the main routine program.

Additionally, if a player depresses the key for a staccato, there is a possibility to proceed from step ST451 to ST452. As described hereinbefore, the microprocessor 12*aa* releases the tone generation control table at step ST452 without a generation of sound. However, most of staccato does not cause the microprocessor 12*aa* to proceed from step ST451 to step ST452, and the staccato is exactly reproduced. Nevertheless, if the microprocessor 12*aa* does not release the tone generation control table in so far as the time interval has been written into the data storage area DWN-CNTR, the control sequence can perfectly reproduce any kind of fingering on the keyboard 10*a*.

Sub-routine Program for Key State "SOUND"

The microprocessor 12*aa* periodically decrements the value in the data storage area during the timer interruption as described hereinbefore. When the time interval is decreased to zero, the key status is changed to SOUND (see step ST102), and the microprocessor 12*aa* is branched from the main routine program to the sub-routine program for the key state SOUND.

Upon entry into the sub-routine program SOUND, the microprocessor 12*aa* checks the register R3L to see whether or not the key has upwardly passed the reference point k2 as by step ST551. If the answer at step ST551 is given affirmative, the microprocessor 12*aa* enters into a sub-routine program for a released key as by step ST552, and the sub-routine program for a released key is described hereinlater.

When the answer at step ST551 is given negative, the microprocessor 12*aa* supplies the music data code representative of "key-off", which is corresponding to "MIDI OFF" of the MIDI standards, to the tone generator 12*ai* as by step ST553, and the tone generator 12*ai* rapidly terminates the electronic sound.

The microprocessor 12*aa* checks the register R3L to see whether or not the key is below the reference point k1 as by step ST554. If the answer at step ST554 is given negative, the key is getting closer and closer to the rest position, and the microprocessor 12*aa* changes the key state stored in the data storage area of the key status table from SOUND to UPPER as by step ST555. Thereafter, the microprocessor 12*aa* returns to the main routine program.

On the other hand, when the answer at step ST554 is given affirmative, the player still lightly depresses the key, and the microprocessor 12*aa* changes the key state from SOUND to HOLD as by step ST556. Thereafter, the microprocessor 12*aa* returns to the main routine program.

Sub-routine for Released Key

The key state SOUND is broken down into SOUND-0 sub-state and SOUND-1 sub-state. The sub-state SOUND-1 is larger in damping factor than the sub-state SOUND-0. The sub-state SOUND-0 and the sub-state SOUND-1 are corresponding to the MIDI codes (AX XX 00) and (AX XX 01), respectively. The key entered into the sub-state SOUND-0 through step ST102, and the key is staying in the sub-state SOUND-0 during the tone generation.

Upon entry into the sub-routine program for a released key, the microprocessor 12*aa* checks the register R3H to see whether or not the key state is the sub-state SOUND-0 as by step ST557. The key has entered into the sub-state SOUND-0 during the tone generation, and the answer at step ST557 is given affirmative. The microprocessor 12*aa* checks the register R3L to see whether or not the key has is still under the reference point k2A as by step ST558. If the answer at step ST558 is given affirmative, the key remains deep, and the microprocessor 12*aa* returns to the main routine program.

On the other hand, if the answer at step ST558 is given negative, the microprocessor 12*aa* rewrites the release rate to a large value such as (AX XX 01), and changes the key state from SOUND-0 to SOUND-1 as by step ST559. The large release rate causes the tone generator 12*ai* to accelerate the termination of the electronic sound. Thereafter, the microprocessor 12*aa* returns to the main routine program.

When the answer at step ST557 is given negative, the key state was changed to SOUND-1 at step ST559 in the previous processing, and the microprocessor 12*aa* checks the register R3L to see whether or not the key is still under the reference point k2A as by step ST560. If he answer at step ST560 is given negative, the key is in the shallow range, and the microprocessor 12*aa* returns to the main routine program.

On the other hand, when the answer at step ST560 is given affirmative, the player makes the key deep again. The microprocessor 12*aa* changes the key state to SOUND-0, and decreases the release rate to, for example, (AX XX 00) represented by the MIDI code. As a result, the tone generator 12*ai* gradually terminates the sound as similar to a piano sound naturally extinguished.

Thus, the controller 12*c* changes the release rate depending upon the key position. As well known to a person skilled in the art, an acoustic piano takes up the vibrations of a string with a damper head. However, the damper head differently extinguishes the sound depending upon the fingering. If the damper head repeats the touch and release, the sound is prolonged. The controller 12*c* faithfully reproduces these sound termination.

Sub-routine Program for Key State "HOLD"

Figure 24:
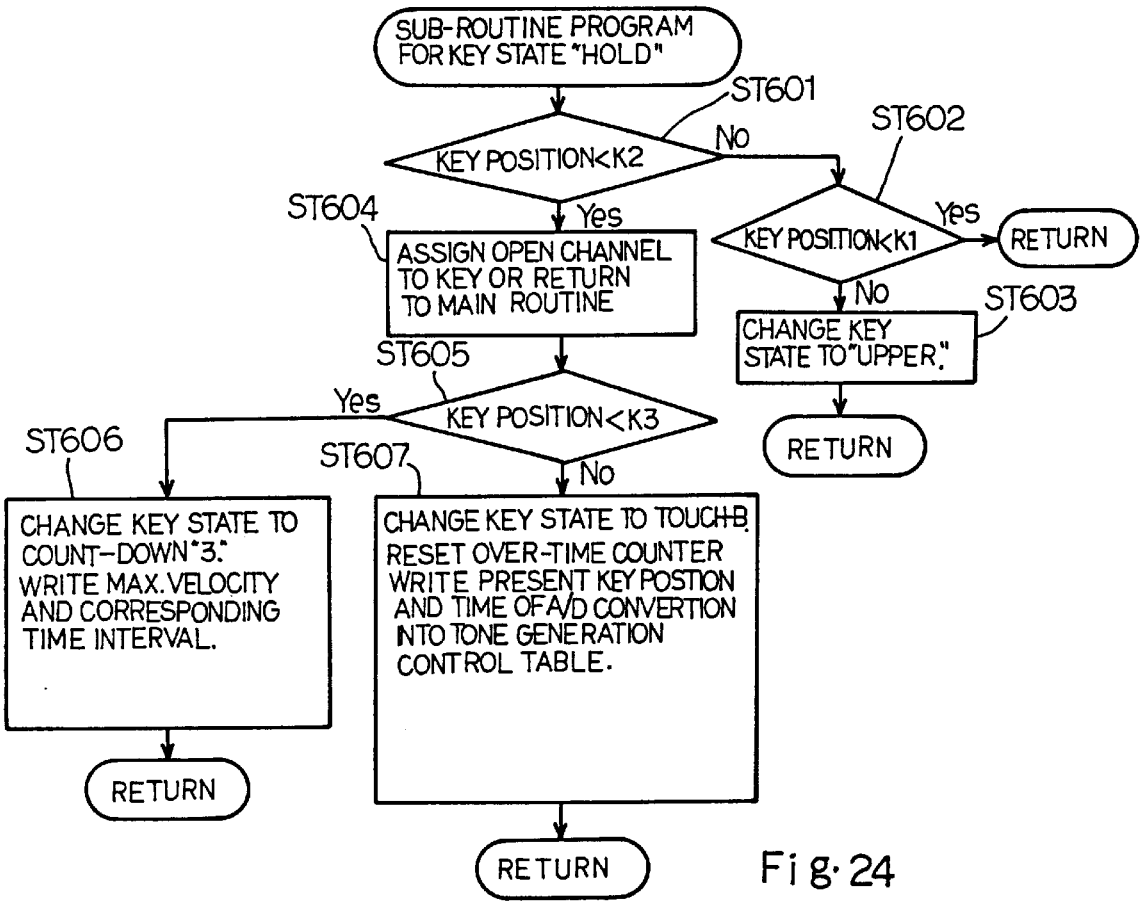
FIG. 24 is a flow chart showing a sub-routine program for the key state HOLD.

FIG. 24 illustrates the sub-routine for the key state HOLD. The microprocessor 12*aa* checks the register R3L to see whether or not the key is under the reference point k2A as by step ST601. If the answer at step ST601 is given negative, the microprocessor 12*aa* further checks to see whether or not the key is under the reference point k1 as by step ST602. In case where the key remains depressed between the reference points k2 and k1, the answer at step ST602 is given affirmative, and the microprocessor 12*aa* returns to the main routine program.

On the other hand, when the answer at step ST602 is given negative, the key is getting closer and closer to the rest position, and the microprocessor 12*aa* changes the key state from HOLD to UPPER as by step ST603. Thereafter, the microprocessor 12*aa* returns to the main routine program.

When the answer at step ST601 is given affirmative, the player depresses the key again, and the microprocessor 12*aa* proceeds to step 604. The microprocessor 12*aa* tries to assign one of the sixteen channels to the key. If there is an open channel, the microprocessor 12*aa* assigns the open channel to the key. However, all the channels have already assigned to other keys, and the microprocessor 12*aa* returns to the main routine program without a key assignment.

When an open channel is assigned to the key, the microprocessor 12*aa* checks the register R3L to see whether or not the key has passed the reference point k3 as by step ST605. If the answer at step ST605 is given affirmative, the key has passed two reference points k2 and k3 at a high speed as similar to the key motion between time tp3 and tp4. The microprocessor 12*aa* changes the key state from HOLD to COUNT-DOWN "3", and writes the maximum hammer velocity "h7F" and the corresponding time interval into the data storage areas VELOCITY and DWN-CNTR of the tone generation control table assigned thereto as by step ST606. Thereafter, the microprocessor 12*aa* returns to the main routine program.

When the answer at step ST605 is given negative, the key is downwardly moved within the standard velocity range as similar to the key motion between time t11 and time t12, and the microprocessor 12*aa* proceeds to step ST607. The microprocessor 12*aa* changes the key state from HOLD to TOUCH-B, and resets the over-time counter. The microprocessor 12*aa* transfers the present key position and the time of A/D conversion from the registers E5 and R3L to the tone generation control table assigned thereto, and writes them into the data storage areas OVR-K2 and OVK2-TIM. Thus, the microprocessor 12*aa* stores the key position when the key passes the threshold K2 and the time when the key passes the threshold K2, and returns to the main routine program.

Sub-routine Program for Key State "TOUCH-B"

Figure 25:
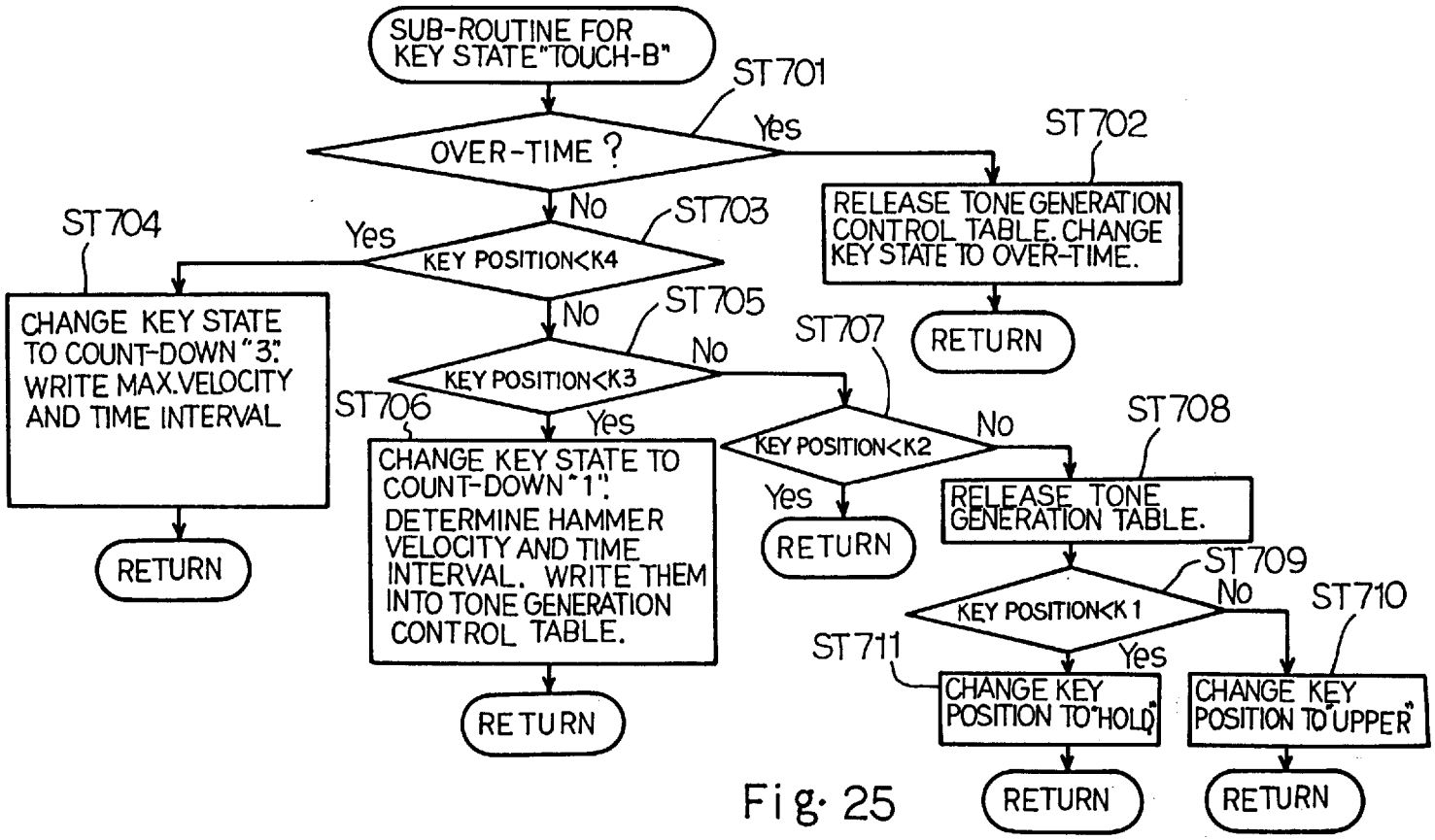
FIG. 25 is a flow chart showing a sub-routine program for the key state TOUCH-B.

FIG. 25 illustrates the sub-routine program for the key state TOUCH-B. The microprocessor 12*aa* firstly checks the over-time counter to see whether or not the over-time counter exceeds the predetermined time period as by step ST701. If the answer at step ST702 is given affirmative, the key staggers between the reference points k2 and k3 (see FIG. 16), by way of example, and there is little possibility to strike a string through a similar key motion of an acoustic piano. The microprocessor 12*aa* releases the tone generation table from the assignment to the key, and changes the key state from TOUCH-B to OVER-TIME as by step ST702 . Thereafter, the microprocessor 12*aa* returns to the main routine program.

On the other hand, when the answer at step ST701 is given negative, the microprocessor 12*aa* checks the register R3L to see whether or not the key is under the reference point k4 as by step ST703. If the answer at step ST703 is given affirmative, the player strongly depressed the key, and the key has passed two reference points k3 and k4, and the microprocessor 12*aa* proceeds to step ST704. The microprocessor 12*aa* writes the maximum hammer velocity and the corresponding time interval into the data storage areas VELOCITY and DWN-CNTR of the tone generation control table assigned thereto. Thereafter, the microprocessor 12*aa* returns to the main routine program.

On the other hand, when the answer at step ST703 is given negative, the microprocessor 12*aa* checks the register R3L again to see whether or not the key is under the reference point k3 as by step ST705. If the answer at step ST705 is given affirmative, the key is moved within the standard velocity range, and the microprocessor 12*aa* proceeds to step ST706. The microprocessor 12*aa* fetches the time and the key position for the reference point k2 from the data storage areas OVR-K2 and OVK2-TIM and the present key position and the time of A/D conversion from the registers R3L and E5, and calculates the key velocity. The microprocessor 12*aa* converts the key velocity to the hammer velocity with reference to the converting table TB2, and determines a time interval corresponding to the hammer velocity with reference to the table TB3-2. The microprocessor 12*aa* transfers the hammer velocity and the time interval to the tone generation table assigned thereto, and writes the hammer velocity and the time interval into the data storage area VELOCITY and DWN-CNTR. Thereafter, the microprocessor 12*aa* returns to the main routine program.

When the answer at step ST705 is given negative, the microprocessor 12*aa* checks the register R31 again to see whether or not the key is under the reference point k2 as by step ST707. If the answer is given affirmative, the key is still within the range between the reference points k2 and k3, and the microprocessor 12*aa* returns to the main routine program.

When the answer at step ST707 is given negative, there is little possibility to strike a string through a similar key motion of an acoustic piano, and the microprocessor 12*aa* releases the tone generation table from the assignment to the key as by step ST708. Thereafter, the microprocessor 12*aa* proceeds to step ST709 to see whether or not the key is under the reference point k1. If the answer at step ST709 is given negative, the key returns toward the rest position, and the microprocessor 12*aa* changes the key position to UPPER as by step ST710. On the other hand, when the answer at step ST709 is given affirmative, the microprocessor 12*aa* changes the key position to HOLD as by step ST711. After steps ST710 or ST711, the microprocessor 12*aa* returns to the main routine program.

Sub-routine Program for Key State "OVER-TIME"

Figure 26:
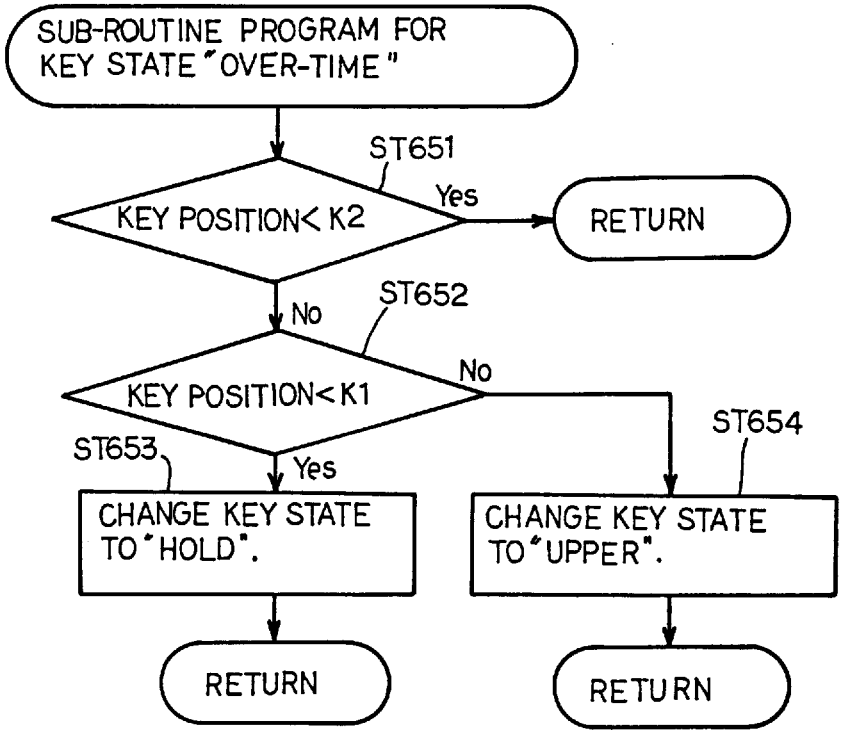
FIG. 26 is a flow chart showing a sub-routine program for the key state TIME-OVER.

FIG. 26 illustrates the sub-routine program for the key state OVER-TIME. The microprocessor 12*aa* checks the register R3L to see whether or not the key is still under the reference point k2 as by step ST651. If the answer at step ST651 is given affirmative, the microprocessor 12*aa* returns to the main routine program. Thus, even if the key is depressed again after the entry into the key state OVERTIME, no sound is generated. If a key of an acoustic piano is depressed to the end position after the stagger between the reference points k2 and k3 over a predetermined time period, the key action mechanism associated therewith does not cause the associated hammer assembly to strike the string. The control sequence through step ST651 is corresponding to the key motion of the acoustic piano, and the keyboard musical instrument according to the present invention exactly simulates the tone generation through different key motions of the acoustic piano.

On the other hand, when the answer at step ST651 is given negative, the microprocessor 12*aa* proceeds to step ST652 to see whether or not the key is under the reference point k1. If the answer at step 652 is given affirmative, the key is moved as similar to the key motion between times t21 and t22, and the microprocessor 12*aa* changes the key state to HOLD as by step ST653. The microprocessor 12*aa* returns to the main routine program.

When the answer at step ST652 is given negative, the key is getting closer and closer to the rest position as similar to the key position between times t22 and t23, and the microprocessor 12*aa* changes the key state to UPPER as by step ST654. Thereafter, the microprocessor 12*aa* returns to the main routine program.

Interrelation between Sub-routine Programs

Figure 27:
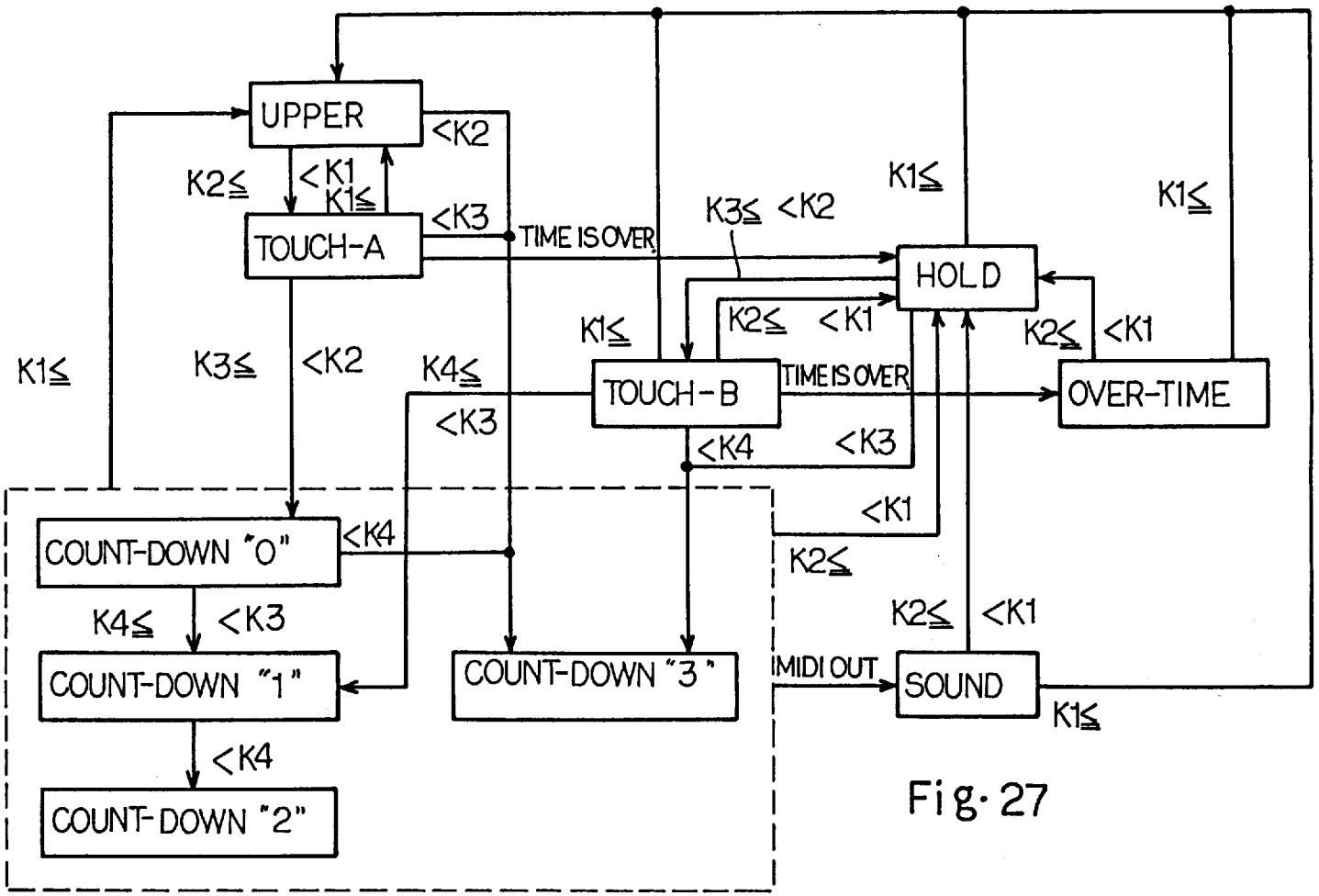
FIG. 27 is a diagram showing the interrelation between the sub-routine programs.

As will be understood from the foregoing description, the microprocessor 12*aa* checks the present key position, and selectively enters into the sub-routine programs. The interrelation between the sub-routine programs is illustrated in FIG. 27.

Assuming now that a player moves one of the black and white keys 10*c*/10*d* as shown in FIGS. 6 and 17, the player starts to depress the key 10*c*/10*d* at time t1, and the microprocessor 12*aa* is branched to the sub-routine program for the key state UPPER. While the key 10*c*/10*d* is being downwardly moved until the reference point k1, the microprocessor 12*aa* reiterates the loop consisting of steps ST306, ST400 and ST401, and the key state is not changed.

When the key 10*c*/10*d* passes the reference point k1, the microprocessor 12*aa* executes steps ST402, ST403 and ST404, and assigns one of the tone generation control table. The key state is changed to,TOUCH-A, and the controller 12*c* is ready for a tone generation.

Thereafter, the microprocessor 12*aa* is branched from the main routine program to the sub-routine program for the key state TOUCH-A. The key passes the reference point k2 at time t2, and the microprocessor 12*aa* is branched from the main routine program to the sub-routine for the key state TOUCH-A. The microprocessor 12*aa* determines the hammer velocity and the time interval corresponding thereto through the execution of steps ST501, ST503, ST505 and ST506, and changes the key state from TOUCH-A to COUNT-DOWN "0". For this reason, the microprocessor 12*aa* is, thereafter, branched from the main routine program to the sub-routine program for the key state COUNT-DOWN.

The key 10*c*/10*d* passes the reference point k3 at time t4, and the microprocessor 12*aa* executes the steps ST457, ST458, ST459 and ST460 so as to determine the hammer velocity and the corresponding time interval. The key state is changed from COUNT-DOWN "0" to COUNT-DOWN "1", and the microprocessor 12*aa* counts down the time interval at every timer interruption.

The key 10*c*/10*d* passes the reference point k4 at time t5, and the microprocessor 12*aa* executes steps ST458, ST461 and ST463. The microprocessor 12*aa* determines the hammer velocity and the corresponding time interval, and changes the hammer velocity and the time interval from the previous values to the new values if the key 10*c*/10*d* is accelerated. Thus, the microprocessor 12*aa* repeats the calculation of the key velocity, and repeatedly determines the hammer velocity and the time interval. If the new hammer velocity is larger than the previous hammer velocity, the microprocessor 12*aa* changes the hammer velocity and the time interval to new values. The microprocessor 12*aa* changes the key state to COUNT-DOWN "2", and repeats the calculation of the key velocity and the determination of the hammer velocity and the time interval. Thus, the largest hammer velocity and the corresponding time interval are left in the data storage areas VELOCITY and DWN-CNTR. When the time interval reaches zero, the microprocessor 12*aa* transfers the music data codes to the tone generator 12*ai* for generating a sound, and changes the key state to SOUND.

The player releases the key at time t7, and the key is upwardly moved toward the rest position. The key passes the reference point k2 at time t10, and the microprocessor 12*aa* transfers the music data code representative of key-off to the tone generator 12*ai* through the execution of steps ST551 and ST553. Thereafter, the microprocessor 12*aa* changes the key state to HOLD at step ST556.

The player depresses the key 10*c*/10*d* again, and the key 10*c*/10*d* passes the reference point k2 at time t11. The microprocessor 12*aa* assigns one of the tone generation control tables to the key 10*c*/10*d* again through the execution of step ST604, and changes the key state to TOUCH-B at step ST607.

The key passes the reference point k3 at time t12 and the reference point k4 at time t13, and the microprocessor 12*aa* repeats the execution of the sub-routine program for the key state COUNT-DOWN.

The time interval reaches zero at time t14, and the microprocessor 12*aa* transfers the music data codes for the tone generation to the tone generator 12*ai*, again. The key 10*c*/10*d* enters the key state HOLD at time t17, The player depresses the key 10*c*/10*d* again, and the key 10*c*/10*d* enters into the key state TOUCH-B at time t18, again. However, the player maintains the key 10*c*/10*d* between the reference points k2 and k3 over the predetermined time period, and the predetermined time period stored in the over-time counter expires. Then, the key state is changed to OVER-TIME. The hammer velocity and the time interval are not determined, and no sound is generated thereafter.

The key 10*c*/10*d* passes the reference point k2 at time t21 and the reference point k1 at time t22, and the key state is changed through HOLD to UPPER.

If the player maintains the key 10*c*/10*d* between the reference points k1 and k2 over the predetermined time period as indicated by the broken lines BL1, the key 10*c*/10*d* enters into the key state OVER-TIME. On the other hand, if the key 10*c*/10*d* upwardly returns as indicated by the broken lines BL2, the key 10*c*/10*d* enters into the key state UPPER.

Moreover, if the key 10*c*/10*d* upwardly returns as indicated by broken lines BL3, the key 10*c*/10*d* enters into the key state HOLD through the execution of steps ST709 and ST711.

When the player strongly depresses the key 10*c*/10*d*, the key 10*c*/10*d* proceeds from the key position P1 to the key position P2 between two sampling works on the key 10*c*/10*d* (see FIG. 17), and the microprocessor 12*aa* determines the maximum hammer velocity and the corresponding time interval during the execution of the sub-routine program for the key state UPPER. The key 10*c*/10*d* enters into the key state COUNT-DOWN "3", and the microprocessor 12*aa* transfers the music data codes for the tone generation to the tone generator when the time interval reaches zero. The key motion between the key positions P3 and P4 is similarly processed.

If the key staggers across the reference point k2A as shown in FIG. 7, the microprocessor 12*aa* enters into the sub-routine program for the release, and changes the release rate. As a result, the sound is delicately extinguished.

Behavior in Acoustic Sound Mode

A player plays music through the acoustic sounds in an acoustic sound mode. While the keyboard musical instrument is staying in the acoustic sound mode, the silent system 11 maintains the cushion units 11*b* at the free position FP, and the hammer heads 10*j* can strike the associated strings 10*f* without an interruption of the cushion units 11*b*.

Assuming now that the player depresses the white key 10*d* during a performance, the white key 10*d* turns in the counter clockwise direction in FIG. 2, and the capstan button 10*k* pushes the heel 10*hc* upwardly. The whippen assembly 10*hb* and the jack 10*he* turn around the whippen flange 10*ha* in the clockwise direction, and the jack 10*he* urges the hammer assembly 10*j* to turn around the butt flange 10*jb* in the clockwise direction.

When the toe 10*hg* is brought into contact with the regulating button 10*hj*, the whippen assembly 10*hb*, which is still turning around the whippen flange 10*ha*, causes the jack 10*he* to turn around the jack flange 10*hd* in the counter clockwise direction against the jack spring 10*hf*. Then, the jack quickly turns around the jack flange 10*hd* in the counter clockwise direction, and the hammer butt 10*ja* escapes from the jack 10*ja*.

The hammer assembly 10*j* starts the free rotation toward the string 10*f*, and strikes it. The string 10*f* vibrates, and generates the acoustic sound. On the other hand, the hammer assembly rebounds on the string 10*f*, and turns in the counter clockwise direction. The catcher 10*je* is brought into collision with the back check 10*jf*, and temporally rests on the back check 10*jf*.

When the player releases the white key 10*d*, the whippen assembly 10*hb* turns around the whippen flange 10*ha* in the counter clockwise direction, and the jack 10*he* returns to the initial position beneath the butt skin 10*ji*.

Thus, the player selectively depresses the black and white keys 10*c* and 10*d*, and the hammer heads 10*jd* associated with the depressed keys 10*c*/10*d* strike the strings 10*f* so as to generate the acoustic sounds for the music.

Behavior in Silent Mode

If a player wants to practice a fingering on the keyboard 10*a*, the player changes the cushion units 11*b* to the blocking position BP. While the player is fingering on the keyboard 10*a*, the white key 10*d* is assumed to be depressed. The white key 10*d* turns in the counter clockwise direction, and the capstan button 10*k* pushes the heel 10*hc* upwardly. The whippen assembly 10*hb* and the jack 10*he* turn around the whippen flange 10*ha* in the clockwise direction, and the jack 10*he* urges the hammer assembly 10*j* to turn around the butt flange 10*jb* in the clockwise direction.

When the toe 10*hg* is brought into contact with the regulating button 10*hj*, the whippen assembly 10*hb* causes the jack 10*he* to turn around the jack flange 10*hd* in the counter clockwise direction against the jack spring 10*hf*. Then, the jack quickly turns around the jack flange 10*hd* in the counter clockwise direction, and the hammer butt 10*ja* escapes from the jack 10*ja*. The player feels the key touch as usual.

The hammer assembly 10*j* starts the free rotation toward the string 10*f*. However, the catcher 10*je* rebounds on the cushion unit 11*b* before the hammer head 10*jd* reaches the string 10*f*. The hammer assembly 10*j* returns to the home position without a strike at the string 10*f*, and no acoustic sound is generated in the silent mode.

While the player is practicing the fingering on the keyboard 11*a*, the controller 12*c* produces the music data codes through the execution of the A/D interruption routine program, the main routine program, the sub-routine programs and the timer interruption routine program, and produces the audio signal from the music data codes. The audio signal is supplied to the headphone 12*d* and/or the speaker system 12*e*, and the headphone 12*d* and/or the speaker system 12*e* generates the electronic sounds corresponding to the depressed keys 10*c*/10*d*.

Behavior in Recording Mode

While a player is performing music, the electronic system 12 generates the music data codes through the execution of the A/D interruption routine program, the main routine program, the sub-routine programs and the timer interruption routine program, and the music data codes are transferred to the floppy disk driver 12*am*. The music data codes are written into the floppy disk 12*an*. If the cushion units 11*b* is in the free position FP, the hammer heads 10*jd* strike the associated strings 10*f*, and the keyboard musical instrument generates the acoustic sounds in response to the fingering. On the other hand, when the cushion units 11*b* is in the blocking position BP, the electronic sounds are produced through the headphone 12*d*/speaker system 12*e*.

Behavior in Playback Mode

When a player instructs the keyboard musical instrument to reproduce the performance, the music data codes are transferred from the floppy disk 12*an* to the random access memory 12*ad*, and the microprocessor 12*aa* instructs the driver circuit 12*ao* to selectively supply the driving current signals to the solenoid-operated actuators 12*b*. The solenoid-operated actuators 12*b* move the associated keys 10*c*/10*d* as if the player repeats the fingering on the keyboard 10*a*, and the hammer heads 12*jd* strike the strings 10*f*. The intensity of each impact is regulated to the original intensity, and the original performance is exactly reproduced.

As will be appreciated from the foregoing description, the keyboard musical instrument embodying the present invention achieves (1) the thresholds are automatically regulated through the execution of step ST302 so as to ignore the individuality of the key sensors;

(2) the thresholds K1 to K4 and K2A and, accordingly, the reference points are arbitrarily adjustable by changing the software;

(3) the controller 12*c* exactly discriminates the key motions such as a shallow key motion, staggered key motion between reference points and a deep key motion so as to faithfully reproduce the original performance;

(4) the previous key state and the previous key position are taken into account so as to exactly determine the present key state such as TOUCH-A, COUNT-DOWN "0" or TOUCH-B, and the lapse of time in the previous key state is further taken into account so as to exactly determine the key state OVER-TIME and HOLD;

(5) the damper action is exactly simulated by changing the release rate;

(6) when a player slowly depresses a key, the microprocessor gives the key state OVER-TIME to the key, and does not allow the tone generator to generate a sound regardless of the key motion thereafter.

In the above described embodiment, the LED driver 12*ak*, the A/D converter 12*aj*, the A/D interruption routine program and steps ST401, ST403, ST451, ST453, ST457, ST458, ST503, ST505, ST507, ST551, ST554, ST558, ST560, ST601, ST602, ST605, ST651, ST652, ST703, ST705, ST707 and ST709 realize a discriminating sub-means. A key-state determining sub-means is realized by steps ST306-311, ST404, ST405, ST404, ST455, ST454, ST455, ST460, ST462, ST463, ST504, ST506, ST555, ST556, ST559, ST561, ST603, ST606, ST607, ST653, ST654, ST704, ST706, ST711 and ST710. Step ST101, ST553, ST559 and ST561 realize a control information generating sub-means.

Although particular embodiments of the present invention have been shown and described, it will be obvious to those skilled in the art that various changes and modifications may be made without departing from the spirit and scope of the present invention.

For example, the shaft member 11*a* may be connected through links and a wire to a nob or a pedal, and a player changes the cushion units 11*b* between the free position FP and the blocking position BP by manipulating the nob or the pedal.

The cushion members 11*b* may enter into trajectories of other parts of the hammer assemblies 10*j* so as to cause the other parts to rebound thereon. The other parts may be the hammer shanks 10*jc* or extensions attached to the leading ends of the hammer shanks 10*jc*.

The keyboard musical instrument may generate electronic sounds having a timbre different from a piano sound. In this instance, the tone generator tailors the envelop representative of the different timbre.

The sub-routine program may control another part of the envelop such as a sustain.

The present invention is available for an electronic keyboard musical instrument without a key action mechanism, a damper mechanism, a hammer assembly and a string.

The key position signals AKP may be available for a feedback control in the playback mode.

In the above described embodiment, the key velocity is calculated from the key motion between the reference points k1 and k2 in TOUCH-A, between k1 and k3 in COUNT-DOWN "0" and between k2 and k4 in COUNT-DOWN "1". However, the key velocity may be calculated on the basis of a key motion between different reference points such as k2 and k3 in COUNT-DOWN "0".

Figure 28:
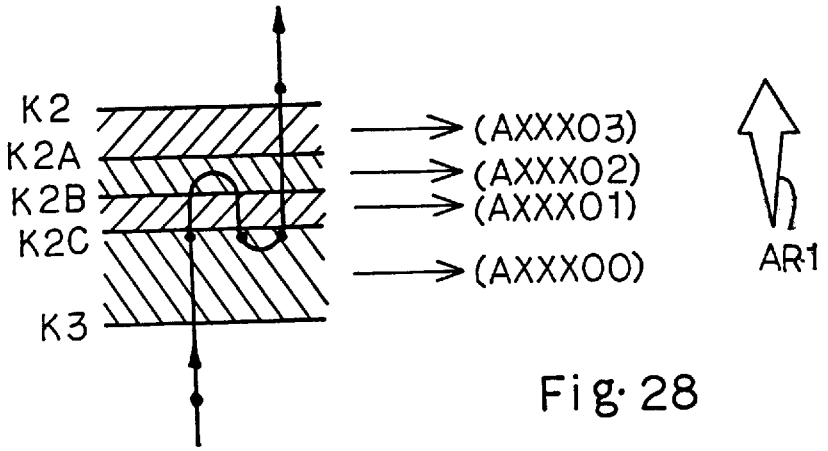
FIG. 28 is a view showing a key motion after release.
Figure 29:
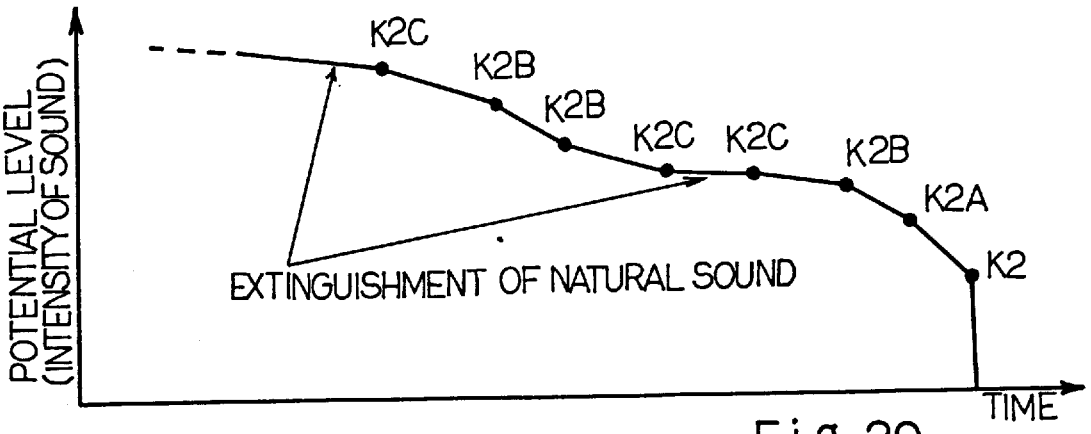
FIG. 29 is a graph showing an envelop of an electronic sound when a release rate is exactly controlled.

In order to exactly control the envelop after the release of a key, the section between the reference points k2 and k3 may be divided into sub-sections as shown in FIG. 28. The damping factor during the extinguishment of a natural sound is gradually increased as represented by an arrow AR1, and the release rate is changed from (AX XX 00) through (AX XX 01) at point k2C, (AX XX 02) at point k2B and (AX XX 03) at point k2A. FIG. 29 illustrates the envelop stepwise decreased as shown in FIG. 28. An extinguishment of natural sound is exactly simulated by the envelop.

Even though the reference points k2C to k2A are provided between the reference points k3 and k2, no additional position sensor is required. Factors are only added to the software for calculating the thresholds.

The reference points may be changed depending upon the player and/or a music score to be performed.

In the embodiment described hereinbefore, when a key passes every reference point, the key velocity is repeatedly calculated, and the new hammer velocity is compared with the previous hammer velocity so as to determine whether or not the previous hammer velocity and the previous time interval are replaced with the new hammer velocity and the new time interval. In another keyboard musical instrument, the new time interval may be compared with the previous time interval, and the comparison of the new time interval with the previous time interval is expected to enhance the precision. Nevertheless, the present inventor confirmed that the comparison in the hammer velocity was matched with the comparison in the time interval, and the comparison in the hammer velocity was smaller in the amount of calculation than the comparison in the time interval.

What is claimed is:

1. A keyboard musical instrument for generating sounds, comprising:

a keyboard including a plurality of keys each reciprocally moved between a rest position and an end position;

a sound generating means responsive to a first piece of control information for starting to generate a sound specified by each of said plurality of keys on the way toward said end position and a second piece of control information for terminating said sound on the way toward said rest position;

a plurality of key sensors respectively monitoring said plurality of keys for generating key position signals respectively representative of motions of associated keys, each of said key position signals continuously varying a value along a trajectory of one of said plurality of keys having a plurality of reference points bounding sections of said trajectory; and a sound controlling means connected to said plurality of key sensors, and controlling said sound generating means, said sound controlling means including a discriminating sub-means periodically comparing said value of said each of said plurality of key position signals with respective thresholds of said plurality of reference points for determining one of said sections where said each of said plurality of keys is moved, a key-state determining sub-means for determining a present key state of said each of said plurality of keys on the basis of said one of said sections and a previous key state which was previously determined by said discriminating sub-means, and a control information generating sub-means for generating a first piece of control information indicative of a generation of sound for said each of said plurality of keys after said present key state is representative of a ready for tone generation, said control information generating sub-means further generating a second piece of control information indicative of a termination of sound for said each of said plurality of keys when the value of said each of said plurality of key position signals is matched with one of said thresholds after entry into said ready for tone generation.

2. The keyboard musical instrument as set forth in claim 1, in which said sound generating means includes a tone generator for producing an electronic sound in response to said first and second pieces of control information.

3. The keyboard musical instrument as set forth in claim 2, in which said sound generating means further includes a plurality of strings for generating acoustic sounds, a plurality of hammer assemblies for striking said plurality of strings, respectively, and a plurality of key action mechanisms responsive to a fingering on said keyboard so as to selectively drive said hammer assemblies for rotation.

4. The keyboard musical instrument as set forth in claim 3, in which said sound generating means further includes a plurality of solenoid-operated actuators respectively associated with said plurality of keys and selectively energized with driving signals so as to move associated ones of said plurality of keys, and a driver circuit responsive to said first and second pieces of control information so as to selectively supply said driving signals to said plurality of solenoid-operated actuators.

5. The keyboard musical instrument as set forth in claim 3, further comprising a silent mechanism changed between a free position and a blocking position, said silent mechanism in said blocking position causing said plurality of hammer assemblies to rebound thereon before striking said plurality of strings, said silent mechanism in said free position allowing said plurality of hammer assemblies to strike said plurality of strings.

6. The keyboard musical instrument as set forth in claim 1, in which said plurality of key sensors are grouped into a plurality of key sensor groups, and each of said plurality of key sensor groups includes a light source shared between the key sensors of said each of said plurality of key sensor groups, a photo-detector shared between said key sensors, a plurality of first sensor heads respectively radiating light beams, a plurality of first optical fibers connected between said light source and said plurality of first sensor heads, a plurality of second sensor heads respectively confronted with said plurality of first sensor heads for receiving said light beams, a plurality of second optical fibers connected between said plurality of second sensor heads and said photo-detector and a plurality of shutter plates respectively attached to keys selected from said plurality of keys and moved through gaps between said plurality of first sensor heads and said plurality of second sensor heads, respectively.

7. The keyboard musical instrument as set forth in claim 6, in which said light beam has a diameter of the order of 5 millimeter.

8. The keyboard musical instrument as set forth in claim 1, in which said key-state determining sub-means determines that said each of said plurality of keys enters into an over-time state when said previous key state is continued over a certain time period, and said control information generating sub-means is prohibited from a generation of said first and second pieces of control information for said each of said plurality of keys after said each of said plurality of keys entered into said over-time state.

9. The keyboard musical instrument as set forth in claim 1, in which said key-state determining sub-means repeatedly determines a time interval until a generation of said first piece of control information while said each of said plurality of keys passes through said sections toward said end position, and said control information generating sub-means supplies said first piece of control information when said time interval expires.

10. The keyboard musical instrument as set forth in claim 1, in which said control information generating sub-means further generates a third piece of control information representative of a release rate of an envelop and variable in dependence on said value of said each of said plurality of key position signals, and said sound generating means decays said sound at a rate corresponding to said third piece of control information.

11. A keyboard musical instrument for generating sounds, comprising:

a keyboard including a plurality of keys each reciprocally moved between a rest position and an end position;

a sound generating means responsive to a first piece of control information for starting to generate a sound specified by each of said plurality of keys on the way toward said end position and a second piece of control information for terminating said sound on the way toward said rest position;

a plurality of key sensors respectively monitoring said plurality of keys for generating analog key position signals respectively representative of motions of associated keys, each of said key position signals continuously varying a value along a trajectory of one of said plurality of keys having a plurality of reference points bounding sections of said trajectory; and a sound controlling means connected to said plurality of key sensors, and controlling said sound generating means, said sound controlling means including a discriminating sub-means periodically comparing said value of said each of said plurality of key position signals with respective thresholds of said plurality of reference points for determining one of said sections where said each of said plurality of keys is moved, a key-state determining sub-means for determining a present key state of said each of said plurality of keys on the basis of said one of said sections and a previous key state which was previously determined by said discriminating sub-means, and a control information generating sub-means for generating a first piece of control information indicative of a generation of sound for said each of said plurality of keys after said present key state is representative of a ready for tone generation, said control information generating sub-means further generating a second piece of control information indicative of a termination of sound for said each of said plurality of keys when the value of said each of said plurality of key position signals is matched with one of said thresholds after entry into said ready for tone generation.

* * * * *